US011060414B2

(12) United States Patent
Uechi et al.

(10) Patent No.: US 11,060,414 B2
(45) Date of Patent: Jul. 13, 2021

(54) STEAM TURBINE AND STEAM TURBINE CONTROL METHOD

(71) Applicant: MITSUBISHI HEAVY INDUSTRIES, LTD., Tokyo (JP)

(72) Inventors: Hideyuki Uechi, Tokyo (JP); Hideaki Sugishita, Tokyo (JP); Takumi Matsumura, Tokyo (JP); Ryo Egami, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 34 days.

(21) Appl. No.: 16/342,443

(22) PCT Filed: Oct. 20, 2017

(86) PCT No.: PCT/JP2017/038024
§ 371 (c)(1),
(2) Date: Apr. 16, 2019

(87) PCT Pub. No.: WO2018/074592
PCT Pub. Date: Apr. 26, 2018

(65) Prior Publication Data

US 2020/0056500 A1 Feb. 20, 2020

(30) Foreign Application Priority Data

Oct. 21, 2016 (JP) ..... JP2016-207165

(51) Int. Cl.
*F01D 17/20* (2006.01)
*F01D 25/24* (2006.01)
(Continued)

(52) U.S. Cl.
CPC ..... *F01D 17/20* (2013.01); *F01D 17/085* (2013.01); *F01D 17/145* (2013.01); *F01D 25/24* (2013.01);
(Continued)

(58) Field of Classification Search
CPC ..... F01D 17/20; F01D 17/145; F01D 17/08; F01D 17/085; F01D 19/02; F01D 21/12;
(Continued)

(56) References Cited

U.S. PATENT DOCUMENTS 3,773,431 A * 11/1973 Bellati ..... F01D 25/28 415/108
5,793,831 A * 8/1998 Tsiklauri ..... F01K 3/181 376/317
(Continued)

FOREIGN PATENT DOCUMENTS

JP 38-11709 6/1963
JP 59-7204 1/1984
(Continued)

OTHER PUBLICATIONS

International Search Report dated Nov. 28, 2017 in International (PCT) Patent Application No. PCT/JP2017/038024, with English Translation.
(Continued)

*Primary Examiner* — David Hamaoui
*Assistant Examiner* — Michael K. Reitz
(74) *Attorney, Agent, or Firm* — Wenderoth, Lind & Ponack, L.L.P.

(57) ABSTRACT

A steam turbine includes an inner casing which has an inner casing body in which a first main flow path to which steam is to be supplied from an inner introduction port is defined, an outer casing which has an outer casing body which defines a second main flow path between the inner casing body and the outer casing body and an upper discharge port and a lower discharge port which are in the outer casing body and through which exhaust steam is to be discharged, an upper valve and a lower valve configured to adjust a flow rate of the exhaust steam which has been discharged, and a
(Continued)

control unit which can independently control the upper valve and the lower valve.

12 Claims, 14 Drawing Sheets

(51) Int. Cl.
*F01D 17/08* (2006.01)
*F01D 17/14* (2006.01)
*F01D 21/12* (2006.01)
*F01D 19/02* (2006.01)

(52) U.S. Cl.
CPC ..... *F01D 19/02* (2013.01); *F01D 21/12* (2013.01); *F05D 2270/303* (2013.01)

(58) Field of Classification Search
CPC .. F01D 25/26; F05D 2220/31; F05D 2220/72; F05D 2250/50; F05D 2250/52
See application file for complete search history.

(56) References Cited

U.S. PATENT DOCUMENTS

| | | | | |
|---|---|---|---|---|
| 8,662,823 | B2 | 3/2014 | Roy et al. | |
| 2011/0167820 | A1 | 7/2011 | Fredriksson et al. | |
| 2013/0064651 | A1* | 3/2013 | Ollivau | F01D 25/24 415/182.1 |
| 2017/0002683 | A1* | 1/2017 | Geveci | F01D 25/26 |
| 2017/0241285 | A1* | 8/2017 | Bennauer | F01D 25/24 |

FOREIGN PATENT DOCUMENTS

| | | |
|---|---|---|
| JP | 4-107403 | 9/1992 |
| JP | 11-270306 | 10/1999 |
| JP | 2012-107618 | 6/2012 |
| JP | 2014-141922 | 8/2014 |

OTHER PUBLICATIONS

Written Opinion of the International Searching Authority dated Nov. 28, 2017 in International (PCT) Patent Application No. PCT/JP2017/038024, with English Translation.

Brilliant, H. M., and Tolpadi, A. K., "Analytical Approach to Steam Turbine Heat Transfer in a Combined Cycle Power Plant", ASME—Paper GT2004—53387, 2004.

Quinkertz, R., Thiemann, T., and Gierse, K., "Validation of Advanced Steam Turbine Technology—A Case Study of an Ultra Super Critical Steam Turbine Power Plant", ASME Paper GT2011—45816, 2011.

* cited by examiner

STEAM TURBINE AND STEAM TURBINE CONTROL METHOD

CROSS-REFERENCE TO RELATED APPLICATION

Priority is claimed from Japanese Patent Application No. 2016-207165, filed on Oct. 21, 2016, the content of which is incorporated herein by reference.

TECHNICAL FIELD

The present invention relates to a steam turbine and a steam turbine control method.

BACKGROUND ART

A steam turbine includes a rotor which rotates about an axis and a casing which covers the rotor. The rotor has a plurality of rotor blades which are disposed around a rotor shaft axially extending about the axis. A plurality of stator vanes which are disposed around the rotor on an upstream side of each rotor blade are provided in the casing.

For example, Japanese Unexamined Patent Application, First Publication No. 2012-107618 discloses a steam turbine having an inner casing to which stator vanes are attached and an outer casing which covers the inner casing from the outside. In the steam turbine, a flow path through which working steam flowing through a working steam flow path between the inner casing and the rotor flows is formed between the outer casing and the inner casing. Accordingly, the outer casing and the inner casing is cooled or heated by the working fluid flowing through the flow path.

SUMMARY OF INVENTION

Technical Problem

Additionally, as described above, even in a case where the flow path through which the steam flows is formed between the outer casing and the inner casing, depending on an operation condition of the steam turbine, a gap between a tip of each rotor blade and an inner peripheral surface of the inner casing or a gap between a tip of each stator vane and the rotor may be inadvertently narrowed.

The present invention provides a steam turbine and a steam turbine control method capable of setting a gap between the rotor side and the inner casing side to an appropriate value.

Solution to Problem

According to a first aspect of the present invention, there is provided a steam turbine including: a rotor which has a rotor body which rotates around an axis extending in a horizontal direction and a plurality of rotor blades which are provided an outer peripheral surface of the rotor body; an inner casing which has an inner casing body which covers the rotor from an outside in a radial direction about the axis and in which a first main flow path through which steam flows is formed between the outer peripheral surface of the rotor and the inner casing body and an inner introduction port through which the steam is supplied to the first main flow path; a plurality of stator vanes which are provided on an inner peripheral surface of the inner casing and are disposed in the first main flow path along with the plurality of rotor blades; an outer casing which has an outer casing body which covers the inner casing from the outside in the radial direction and forms a second main flow path which communicates with the first main flow path between an outer peripheral surface of the inner casing body and the outer casing body and through which exhaust steam flows, an outer introduction port through which the steam is introduced into the inner introduction port, an upper discharge port which is provided in an upper portion of the outer casing body and through which the exhaust steam is discharged from the second main flow path, and a lower discharge port which is provided in a lower portion of the outer casing body and through which the exhaust steam is discharged from the second main flow path; an upper valve which adjusts a flow rate of the exhaust steam discharged from the upper discharge port; a lower valve which adjusts a flow rate of the exhaust steam discharged from the lower discharge port; and a control unit which is able to independently control the upper valve and the lower valve.

According to this configuration, it is possible to control exhaust steam such that more exhaust steam flows to one of the upper portion and the lower portion of the outer casing by independently controlling the upper valve and the lower valve. By causing more exhaust steam having a high temperature or a low temperature to flow to the upper portion or the lower portion of the outer casing depending on an operation condition the steam turbine, it is possible to promote deformation of the outer casing and set a clearance between the rotor and the inner casing to an appropriate value.

In the steam turbine, the outer casing may have a flange portion which extends to one side in the horizontal direction and the other side in the horizontal direction from the outer casing body and is supported by a frame from below, in a case where a temperature of the exhaust steam is higher than a predetermined temperature, the control unit may control the upper valve and the lower valve such that more exhaust steam flows to a portion, which moves to the rotor side according to deformation of the flange portion, of an upper portion and a lower portion of the outer casing, and in a case where a temperature of the exhaust steam is lower than the predetermined temperature, the control unit may control the upper valve and the lower valve such that more exhaust steam flows to a portion opposite to the portion, which moves to the rotor side according to deformation of the flange portion, of the upper portion and the lower portion of the outer casing.

According to this configuration, in outer casing, the portion in which the outer casing moves to the rotor side is expanded or the portion opposite to the portion in which the outer casing moves to the rotor side is shrunk using the exhaust steam, and thus, it is possible to a gap between the rotor and the inner casing to an appropriate value.

In the steam turbine, the steam turbine may further include a casing temperature sensor which measures a temperature of the outer casing body, and a flange portion temperature sensor which measures a temperature of a flange portion, in which the outer casing may have the flange portion which extends to one side in the horizontal direction and the other side in the horizontal direction from the outer casing body and is supported by a frame from below, the outer casing body may have an upper casing body which is disposed on an upper side and has a first opening portion which is open downward and a lower casing body which is disposed on a lower side and has a second opening portion which is open upward, the flange portion may have an upper half flange which is disposed on an upper side, extends in the horizontal direction from the first opening portion, and is supported by the frame from below and a lower half flange which is disposed on a lower side, extends in the horizontal direction from the second opening portion, and is fastened to the upper half flange, and when the temperature of the outer casing body is denoted by Tc, the temperature of the flange portion is denoted by Tf, a first threshold of a temperature is denoted by Tsh1, and a second threshold of a temperature higher than the first threshold Tsh1 is denoted by Tsh2, in a case of $Tc-Tf<Tsh1$, the control unit may control the upper valve and the lower valve such that more exhaust steam flows to the lower casing body side of the upper casing body and the lower casing body, in a case of $Tsh1 \leq Tc-Tf \leq Tsh2$, the control unit may open the upper valve and the lower valve, and in a case of $Tsh2<Tc-Tf$, the control unit may control the upper valve and the lower valve such that more exhaust steam flows to the lower casing body side of the upper casing body and the lower casing body.

According to this configuration, a more accurate control is possible by performing the control with reference to the temperature of each portion.

In the steam turbine, the steam turbine may further include a casing temperature sensor which measures a temperature of the outer casing body, and a flange portion temperature sensor which measures a temperature of a flange portion, and an exhaust temperature sensor which measures a temperature of the exhaust steam, in which the outer casing may have the flange portion which extends to one side in the horizontal direction and the other side in the horizontal direction from the outer casing body and is supported by a frame from below, the outer casing body may have an upper casing body which is disposed on an upper side and has a first opening portion which is open downward and a lower casing body which is disposed on a lower side and has a second opening portion which is open upward, the flange portion may have an upper half flange which is disposed on an upper side, extends in the horizontal direction from the first opening portion, and is supported by the frame from below and a lower half flange which is disposed on a lower side, extends in the horizontal direction from the second opening portion, and is fastened to the upper half flange, and when the temperature of the outer casing body is denoted by Tc, the temperature of the flange portion is denoted by Tf, a first threshold of a temperature is denoted by Tsh1, a second threshold of a temperature higher than the first threshold Tsh1 is denoted by Tsh2, a temperature of the exhaust steam is denoted by Tse, and a third threshold of a temperature is denoted by Tsh3, in a case of $Tc-Tf<Tsh1$ and $Tc-Tse<Tsh3$, the control unit may control the upper valve and the lower valve such that more exhaust steam flows to the upper casing body side of the upper casing body and the lower casing body, in a case of $Tc-Tf<Tsh1$ and $Tc-Tse \geq Tsh3$, the control unit may control the upper valve and the lower valve such that more exhaust steam flows to the lower casing body side of the upper casing body and the lower casing body, in a case of $Tsh1 \leq Tc-Tf<Tsh2$, the control unit may open the upper valve and the lower valve, in a case of $Tsh2<Tc-Tf$ and $Tc-Tse<Tsh3$, the control unit may control the upper valve and the lower valve such that more exhaust steam flows to the lower casing body side of the upper casing body and the lower casing body, and in a case of $Tsh2<Tc-Tf$ and $Tc-Tse \geq Tsh3$, the control unit may control the upper valve and the lower valve such that more exhaust steam flows to the upper casing body side of the upper casing body and the lower casing body.

According to this configuration, by adding the temperature of the exhaust steam as a determination criteria, even in case where the temperature of the exhaust temperature is different from an assumed value due to switching of an operating state or the like, an accurate control can be performed.

In the steam turbine, the steam turbine may further include a casing temperature sensor which measures a temperature of the outer casing body and a flange portion temperature sensor which measures a temperature of a flange portion, in which the outer casing may have the flange portion which extends to one side in the horizontal direction and the other side in the horizontal direction from the outer casing body and is supported by a frame from below, the outer casing body may have an upper casing body which is disposed on an upper side and has a first opening portion which is open downward and a lower casing body which is disposed on a lower side and has a second opening portion which is open upward, the flange portion may have a lower half flange which is disposed on a lower side, extends in the horizontal direction from the second opening portion, and is supported by the frame from below and an upper half flange which is disposed on an upper side, extends in the horizontal direction from the first opening portion, and is fastened to the lower half flange, and when the temperature of the outer casing body is denoted by Tc, the temperature of the flange portion is denoted by Tf, a first threshold of a temperature is denoted by Tsh1, and a second threshold of a temperature higher than the first threshold Tsh1 is denoted by Tsh2, in a case of $Tc-Tf<Tsh1$, the control unit may control the upper valve and the lower valve such that more exhaust steam flows to the upper casing body side of the upper casing body and the lower casing body, in a case of $Tsh1 \leq Tc-Tf \leq Tsh2$, the control unit may open the upper valve and the lower valve, and in a case of $Tsh2<Tc-Tf$, the control unit may control the upper valve and the lower valve such that more exhaust steam flows to the upper casing body side of the upper casing body and the lower casing body.

In the steam turbine, the stream turbine may further include a casing temperature sensor which measures a temperature of the outer casing body, a flange portion temperature sensor which measures a temperature of a flange portion, and an exhaust temperature sensor which measures a temperature of the exhaust steam, the outer casing may have the flange portion which extends to one side in the horizontal direction and the other side in the horizontal direction from the outer casing body and is supported by a frame from below, the outer casing body may have an upper casing body which is disposed on an upper side and has a first opening portion which is open downward and a lower casing body which is disposed on a lower side and has a second opening portion which is open upward, the flange portion may have a lower half flange which is disposed on a lower side, extends in the horizontal direction from the second opening portion, and is supported by the frame from below and an upper half flange which is disposed on an upper side, extends in the horizontal direction from the first opening portion, and is fastened to the lower half flange, and when the temperature of the outer casing body is denoted by Tc, the temperature of the flange portion is denoted by Tf, a first threshold of a temperature is denoted by Tsh1, a second threshold of a temperature higher than the first threshold Tsh1 is denoted by Tsh2, a temperature of the exhaust steam is denoted by Tse, and a third threshold of a temperature is denoted by Tsh3, in a case of $Tc-Tf<Tsh1$ and $Tc-Tse<Tsh3$, the control unit may control the upper valve and the lower valve such that more exhaust steam flows to the lower casing body side of the upper casing body and the lower casing body, in a case of $Tc-Tf<Tsh1$ and $Tc-Tse \geq Tsh3$, the control unit may control the upper valve and the lower valve such that more exhaust steam flows to the upper casing body side of the upper casing body and the lower casing body, in a case of $Tsh1 \leq Tc-Tf \leq Tsh2$, the control unit may open the upper valve and the lower valve, in a case of $Tsh2 < Tc-Tf$ and $Tc-Tse < Tsh3$, the control unit may control the upper valve and the lower valve such that more exhaust steam flows to the upper casing body side of the upper casing body and the lower casing body, and in a case of $Tsh2 < Tc-Tf$ and $Tc-Tse \geq Tsh3$, the control unit may control the upper valve and the lower valve such that more exhaust steam flows to the lower casing body side of the upper casing body and the lower casing body.

In the steam turbine, the steam turbine may further include a closing plate which is a plate-shaped member formed over an outer peripheral surface of the inner casing body and the outer casing body and divides the second main flow path vertically.

According to this configuration, it is possible to reliably switch the flow of the exhaust steam of the steam turbine by switching between the upper valve and the lower valve.

In the steam turbine, the steam turbine may further include a baffle plate which uniformly restricts a flow path area of the exhaust steam from the first main flow path to the second main flow path in a circumferential direction and is formed in a plate shape having a main plane orthogonal to the axis.

According to the embodiment, the exhaust steam flows through a narrow gap, and thus, the flow of the exhaust steam is more uniform in the circumferential direction. Accordingly, it is possible to prevent unevenness from occurring in a flow rate of the exhaust stream in the circumferential direction.

According to a second aspect of the present invention, there is provided a control method of a steam turbine, the steam turbine including a rotor which has a rotor body which rotates around an axis extending in a horizontal direction and a plurality of rotor blades which are provided an outer peripheral surface of the rotor body, an inner casing which has an inner casing body which covers the rotor from an outside in a radial direction about the axis and in which a first main flow path through which steam flows is formed between an outer peripheral surface of the rotor and the inner casing body and an inner introduction port through which the steam is supplied to the first main flow path, a plurality of stator vanes which are provided on an inner peripheral surface of the inner casing and are disposed in the first main flow path along with the plurality of rotor blades, and an outer casing which has an outer casing body which covers the inner casing from the outside in the radial direction and forms a second main flow path which communicates with the first main flow path between an outer peripheral surface of the inner casing body and the outer casing body and through which exhaust steam flows, an outer introduction port through which the steam is introduced into the inner introduction port, an upper discharge port which is provided in an upper portion of the outer casing body and through which the exhaust steam is discharged from the second main flow path, a lower discharge port which is provided in a lower portion of the outer casing body and through which the exhaust steam is discharged from the second main flow path, and a flange portion which extends to one side in the horizontal direction and the other side in the horizontal direction from the outer casing body and is supported by a frame from below, the outer casing body having an upper casing body which is disposed on an upper side and has a first opening portion which is open downward and a lower casing body which is disposed on a lower side and has a second opening portion which is open upward, the flange portion having an outer casing which has an upper half flange which is disposed on an upper side, extends in the horizontal direction from the first opening portion, and is supported by the frame from below and a lower half flange which is disposed on a lower side, extends in the horizontal direction from the second opening portion, and is fastened to the upper half flange, an upper valve which adjusts a flow rate of the exhaust steam discharged from the upper discharge port, and a lower valve which adjusts a flow rate of the exhaust steam discharged from the lower discharge port, the control method including: when a temperature of the outer casing body is denoted by Tc, a temperature of the flange portion is denoted by Tf, a first threshold of a temperature is denoted by Tsh1, and a second threshold of a temperature higher than the first threshold Tsh1 is denoted by Tsh2, controlling, in a case of $Tc-Tf < Tsh1$, the upper valve and the lower valve such that more exhaust steam flows to the lower casing body side of the upper casing body and the lower casing body; opening, in a case of $Tsh1 \leq Tc-Tf \leq Tsh2$, the upper valve and the lower valve; and controlling, in a case of $Tsh2 < Tc-Tf$, the upper valve and the lower valve such that more exhaust steam flows to the lower casing body side of the upper casing body and the lower casing body.

According to a third aspect of the present invention, there is provided a control method of a stream turbine, the control method of a steam turbine including: controlling, in a case of $Tc-Tf < Tsh1$ and $Tc-Tse < Tsh3$, the upper valve and the lower valve such that more exhaust steam flows to the upper casing body side of the upper casing body and the lower casing body; controlling, in a case of $Tc-Tf < Tsh1$ and $Tc-Tse \geq Tsh3$, the upper valve and the lower valve such that more exhaust steam flows to the lower casing body side of the upper casing body and the lower casing body; opening, in a case of $Tsh1 \leq Tc-Tf \leq Tsh2$, the upper valve and the lower valve; controlling, in a case of $Tsh2 < Tc-Tf$ and $Tc-Tse < Tsh3$, the upper valve and the lower valve such that more exhaust steam flows to the lower casing body side of the upper casing body and the lower casing body; and controlling, in a case of $Tsh2 < Tc-Tf$ and $Tc-Tse \geq Tsh3$, the upper valve and the lower valve such that more exhaust steam flows to the upper casing body side of the upper casing body and the lower casing body.

According to a fourth aspect of the present invention, there is provided a control method of a steam turbine, the steam turbine including a rotor which has a rotor body which rotates around an axis extending in a horizontal direction and a plurality of rotor blades which are provided an outer peripheral surface of the rotor body, an inner casing which has an inner casing body which covers the rotor from an outside in a radial direction about the axis and in which a first main flow path through which steam flows is formed between an outer peripheral surface of the rotor and the inner casing body and an inner introduction port through which the steam is supplied to the first main flow path, a plurality of stator vanes which are provided on an inner peripheral surface of the inner casing and are disposed in the first main flow path along with the plurality of rotor blades, and an outer casing which has an outer casing body which covers the inner casing from the outside in the radial direction and forms a second main flow path which communicates with the first main flow path between an outer peripheral surface of the inner casing body and the outer casing body and through which exhaust steam flows, an outer introduction port through which the steam is introduced into the inner introduction port, an upper discharge port which is provided in an upper portion of the outer casing body and through which the exhaust steam is discharged from the second main flow path, a lower discharge port which is provided in a lower portion of the outer casing body and through which the exhaust steam is discharged from the second main flow path, and a flange portion which extends to one side in the horizontal direction and the other side in the horizontal direction from the outer casing body and is supported by a frame from below, the outer casing body having an upper casing body which is disposed on an upper side and has a first opening portion which is open downward and a lower casing body which is disposed on a lower side and has a second opening portion which is open upward, the flange portion having an outer casing which has a lower half flange which is disposed on a lower side, extends in the horizontal direction from the second opening portion, and is supported by the frame from below and an upper half flange which is disposed on an upper side, extends in the horizontal direction from the first opening portion, and is fastened to the lower half flange and, an upper valve which adjusts a flow rate of the exhaust steam discharged from the upper discharge port, and a lower valve which adjusts a flow rate of the exhaust steam discharged from the lower discharge port, the control method including: when a temperature of the outer casing body is denoted by Tc, a temperature of the flange portion is denoted by Tf, a first threshold of a temperature is denoted by Tsh1, and a second threshold of a temperature higher than the first threshold Tsh1 is denoted by Tsh2, controlling, in a case of $Tc-Tf<Tsh1$, the upper valve and the lower valve such that more exhaust steam flows to the upper casing body side of the upper casing body and the lower casing body, opening, in a case of $Tsh1 \leq Tc-Tf \leq Tsh2$, the upper valve and the lower valve, and controlling, in a case of $Tsh2<Tc-Tf$, the upper valve and the lower valve such that more exhaust steam flows to the upper casing body side of the upper casing body and the lower casing body.

According to a fifth aspect of the present invention, there is provided a control method of a steam turbine, the control method of a steam turbine including: controlling, in a case of $Tc-Tf<Tsh1$ and $Tc-Tse<Tsh3$, the upper valve and the lower valve such that more exhaust steam flows to the lower casing body side of the upper casing body and the lower casing body; controlling, in a case of $Tc-Tf<Tsh1$ and $Tc-Tse \geq Tsh3$, the upper valve and the lower valve such that more exhaust steam flows to the upper casing body side of the upper casing body and the lower casing body; opening, in a case of $Tsh1 \leq Tc-Tf \leq Tsh2$, the upper valve and the lower valve; controlling, in a case of $Tsh2<Tc-Tf$ and $Tc-Tse<Tsh3$, the upper valve and the lower valve such that more exhaust steam flows to the upper casing body side of the upper casing body and the lower casing body; and controlling, in a case of $Tsh2<Tc-Tf$ and $Tc-Tse \geq Tsh3$, the upper valve and the lower valve such that more exhaust steam flows to the lower casing body side of the upper casing body and the lower casing body.

Advantageous Effects of Invention

According to the present invention, it is possible to control exhaust steam such that more exhaust steam flows to one of an upper portion and a lower portion of an outer casing by independently controlling an upper valve and a lower valve. By causing more exhaust steam having a high temperature or a low temperature to flow to the upper portion or the lower portion of the outer casing depending on an operation condition the steam turbine, it is possible to promote deformation of the outer casing and set a clearance between a rotor and an inner casing to an appropriate value.

DESCRIPTION OF EMBODIMENTS

Hereinafter, a steam turbine 1 of an embodiment of the present invention will be described in detail with reference to the drawings.

First Embodiment

The steam turbine 1 is an internal combustion engine which extracts energy of steam as rotation power and is used for a generator in a power plant.

Figure 1:
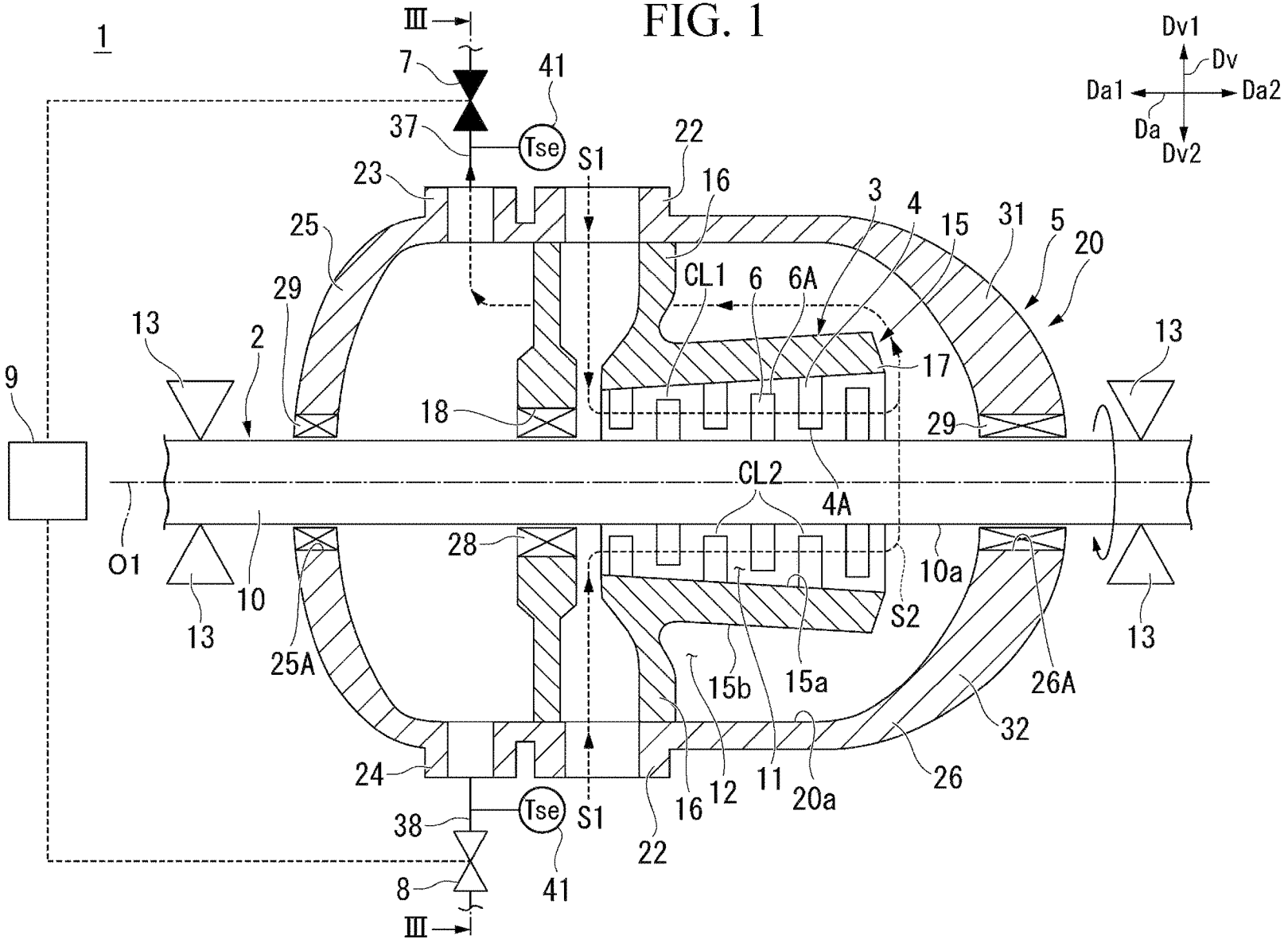
FIG. 1 is a sectional view showing a configuration of a steam turbine of a first embodiment of the present invention.

As shown in FIG. 1, the steam turbine 1 of the present embodiment includes a rotor 2 which rotates around an axis O1 extending in a horizontal direction, an inner casing 3 which covers the rotor 2 from an outside in a radial direction about the axis O1 of the rotor 2, a plurality of stator vanes 4 which are provided on an inner peripheral surface 15*a* of the inner casing 3, an outer casing 5 which covers the inner casing 3 from the outside in the radial direction, bearing portions 13 which rotatably support both ends of the rotor 2, an upper valve 7 and a lower valve 8 which adjust a flow rate of exhaust steam S2 discharged from the outer casing 5, seal portions 28 and 29 which prevent leakage of the steam, and a control unit 9.

Moreover, in the following descriptions, an extension direction of the axis O1 of the rotor 2 is referred to as an axial direction Da, a radial direction about the axis O1 of the rotor 2 is simply referred to as a radial direction, and a circumferential direction about the axis O1 of the rotor 2 is simply referred to as a circumferential direction. In addition, in the axial direction Da, a left side in FIG. 1 is referred to as one side Da1 in the axial direction, and a right side in FIG. 1 is referred to as the other side Da2 in the axial direction. Moreover, in a direction orthogonal to the axial direction Da, a direction along a paper surface of FIG. 1 is referred to as an upward-downward direction Dv, an upper side on the paper surface of FIG. 1 is referred to as an upper side, and a lower side on the paper surface is referred to as a lower side.

The rotor 2 is rotatably supported about the axis O1 extending in the horizontal direction. The rotor 2 has a rotor body 10 which rotates around the axis O1 and extends in the axial direction Da and a plurality of rotor blades 6 which are provided on an outer peripheral surface of the rotor body 10. In the rotor body 10, a hollow portion in which the rotor blades 6 are provided is accommodated inside the inner casing 3. Both end portions of the rotor body 10 protrude to the outside of the outer casing 5. Both end portions of the rotor body 10 are rotatably supported by the bearing portions 13.

The plurality of rotor blades 6 are fixed to the outer peripheral surface of the rotor body 10. The plurality of rotor blades 6 are arranged in the circumferential direction. The rotor blades 6 receive a pressure of steam S1 flowing in the axial direction Da and rotate the rotor 2 around the axis O1. In each rotor blade 6, a tip surface 6A facing the outside in the radial direction faces the inner peripheral surface 15*a* of the inner casing 3.

The inner casing 3 covers the rotor 2 from the outside in the radial direction. The inner casing 3 covers the rotor 2 from the outside in the radial direction in a state where a gap CL1 is formed between the tip surface 6A of each rotor blade 6 and the inner casing 3. A first main flow path 11 is formed between the inner casing 3 and the rotor body 10.

The inner casing 3 has a cylindrical inner casing body 15 whose diameter gradually increases toward the other side Da2 in the axial direction, an inner introduction port 16 through which the steam S1 is supplied to the first main flow path 11, and an inner discharge port 17 through which the exhaust steam S2 is discharged to the second main flow path 12 described later. An inner insertion hole 18 into which the rotor 2 is inserted is formed on the one side Da1 of the inner casing body 15 in the axial direction.

The inner introduction port 16 is formed on the one side Da1 (an upstream side in a flow direction of the steam S1) in the axial direction of the first main flow path 11. The steam S1 flows from the outside in the radial direction into the first main flow path 11 through the inner introduction port 16. The inner introduction ports 16 are formed in an upper portion and a lower portion of the inner casing body 15 at equal intervals in the circumferential direction. The steam turbine 1 of the present embodiment has two inner introduction ports 16.

The inner discharge port 17 is formed on the other side Da2 (a downstream side in the flow direction of the steam S1) in the axial direction of the first main flow path 11. The exhaust steam S2 is discharged from the first main flow path 11 to the other side Da2 in the axial direction through the inner discharge port 17. The inner discharge port 17 is an opening which is formed in an end portion of the inner casing body 15 on the other side Da2 in the axial direction.

The plurality of stator vanes 4 are fixed to the inner peripheral surface 15*a* of the inner casing body 15. The plurality of stator vanes 4 are disposed to be arranged in the circumferential direction. In each stator vane 4, a tip surface 4A facing the inside in the radial direction faces an outer peripheral surface 10*a* of the rotor body 10. A gap CL2 is formed between the tip surface 4A of each stator vane 4 and the rotor body 10.

In the first main flow path 11, the rotor blades 6 and the stator vanes 4 are alternately disposed in the axial direction Da. A pair of rotor blade 6 and stator vane 4 constitutes one "stage", and in the steam turbine 1, a plurality of stages are provided. The stages are configured such that a blade height (a length of the blade in a direction orthogonal to the axis O1) of each of the rotor blades 6 and the stator vanes 4 increases from an upstream side of the first main flow path 11 toward a downstream side thereof.

Figure 2:
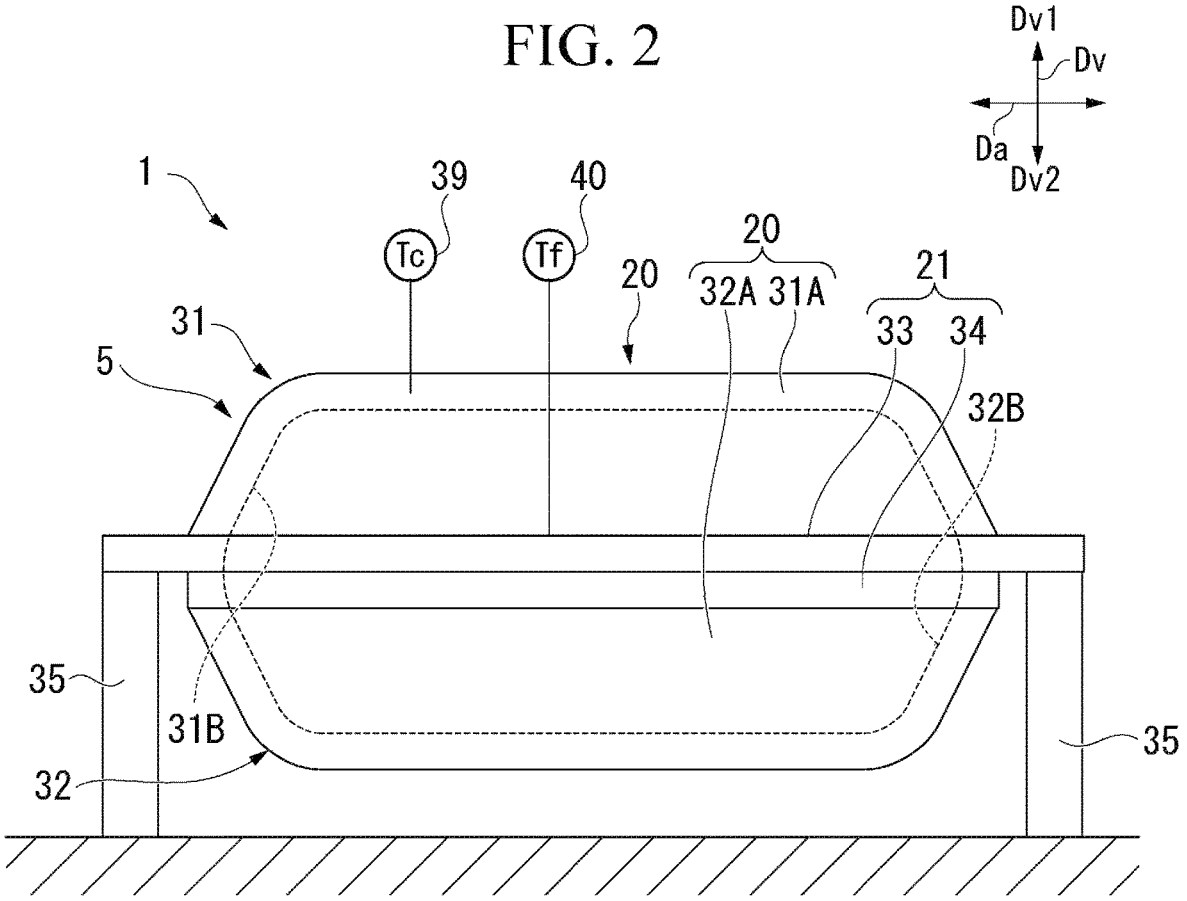
FIG. 2 is a side view showing a configuration and a support structure of an outer casing of the steam turbine in the first embodiment of the present invention.

As shown in FIGS. 1 and 2, the outer casing 5 has an outer casing body 20 which covers the inner casing 3 from the outside in the radial direction, a flange portion 21, an outer introduction port 22 through which the steam S1 is introduced into the inner introduction port 16, two upper discharge ports 23 (only one is shown in FIG. 1) which are formed in an upper portion of the outer casing body 20, and two lower discharge ports 24 (only one is shown in FIG. 1) which are formed in a lower portion of the outer casing body 20.

The outer casing body 20 is formed in a cylindrical shape having lid portions 25 and 26 on both end portions in the axial direction Da. The second main flow path 12 which communicates with the first main flow path 11 and through which the exhaust steam S2 flows is formed between an inner peripheral surface 20*a* of the outer casing body 20 and an outer peripheral surface 15*b* of the inner casing body 15. The outer casing 20 on the one side Da1 in the axial direction is closed by the first lid portion 25. The outer casing 20 on the other side Da2 in the axial direction is closed by the second lid portion 26. A first outer insertion hole 25A and a second outer insertion hole 26A into which the rotor 2 is inserted are formed in the first lid portion 25 and the second lid portion 26.

A position of the outer introduction port 22 in the axial direction Da is the same as a position of the inner introduction port 16 in the axial direction Da. The outer introduction port 22 is formed radially outside the inner introduction port 16. The steam S1 flows from the outside in the radial direction into the inner introduction port 16 through the outer introduction port 22. The outer introduction ports 22 are formed in the upper portion and the lower portion of the outer casing body 20 at equal intervals in the circumferential direction. In addition, the number of the inner introduction ports 16 and the number of the outer introduction ports 22 are not limited to two. For example, one inner introduction port 16 and one outer introduction port 22 may be provided, or three or more inner introduction ports 16 and three or more outer introduction port 22 may be provided.

Figure 3:
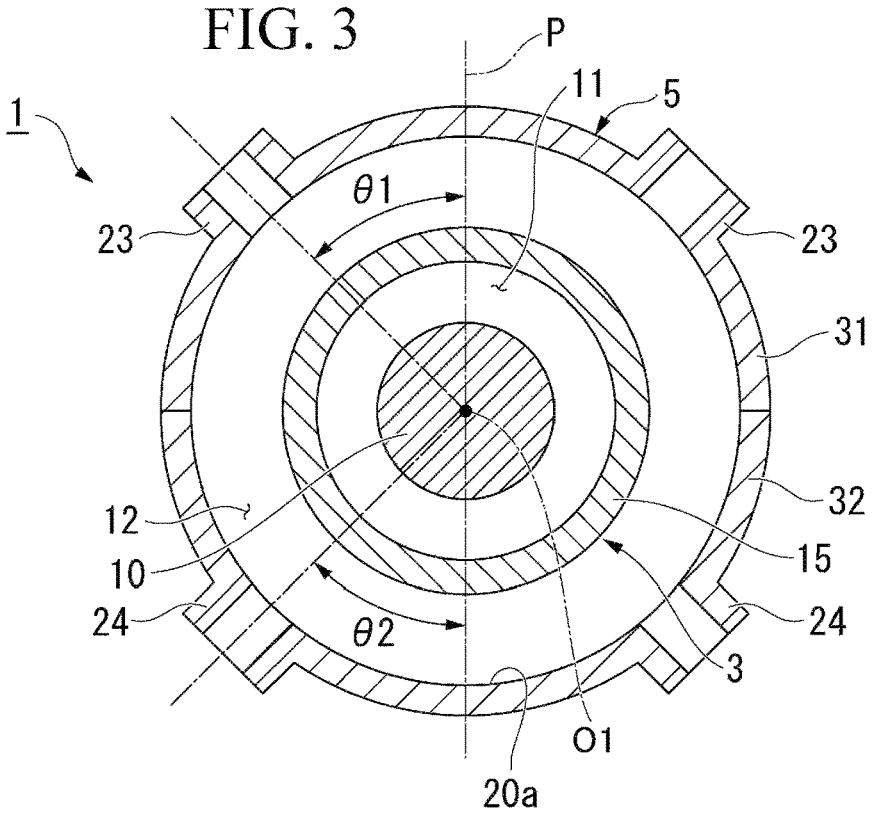
FIG. 3 is a sectional view taken along line III-III of FIG. 1 and is a sectional view explaining positions of an upper discharge port and a lower discharge port in the steam turbine of the first embodiment of the present invention.

As shown in FIG. 3, two upper discharge ports 23 and two lower discharge ports 24 are formed at equal intervals in the circumferential direction. The two upper discharge ports 23 and the two lower discharge ports 24 are symmetrically disposed with respect to a horizontal plane including the axis O1. The upper discharge ports 23 and the lower discharge ports 24 are formed in the outer introduction port 22 on the one side Da1 in the axial direction.

When viewed in the axial direction Da, the upper discharge ports 23 are formed such that an angle θ1 between a center axis of the upper discharge port 23 and a plane P including the axis O1 along the vertical direction is 40° to 50°. When viewed in the axial direction Da, the lower discharge ports 24 are formed such that an angle θ2 between a center axis of the lower discharge port 24 and the plane P including the axis O1 along the vertical direction is 40° to 50°.

The outer casing 5 is divided into two in the upward-downward direction Dv. The outer casing 5 is divided into an upper casing 31 which is provided on the upper side and a lower casing 32 which is provided on the lower side.

The upper casing 31 has an upper casing body 31A having a first opening portion 31B which is open downward and an upper half flange 33 which protrudes in the horizontal direction from the first opening portion 31B of the upper casing body 31A.

The lower casing 32 is a lower casing body 32A having a second opening portion 32B which is open upward and a lower half flange 34 which protrudes in the horizontal direction from the second opening portion 32B of the lower casing body 32A.

In other words, the flange portion 21 has the upper half flange 33 and the lower half flange 34. For example, the upper half flange 33 and the lower half flange 34 are fastened to each other by a bolt.

As shown in FIG. 2, in the flange portion 21 of the present embodiment, the upper half flange 33 is larger (longer) than the lower half flange 34.

The upper half flange 33 (outer casing 5) is placed on a frame 35 and thus, is supported by the frame 35. The steam turbine 1 of the present embodiment is supported by the frame 35 via the upper half flange 33. This support method is referred to as an upper half flange support, and this structure is referred to as an upper half flange support structure.

The upper half flange 33 and the frame 35 are not fastened to each other. Additionally, the rotor 2 is rotatably supported by the bearing portions 13, and thus, if the outer casing 5 moves upward or downward, dimensions of the gap CL1 and the gap CL2 are changed.

The bearing portions 13 rotatably support the rotor 2 around the axis O1. The bearing portions 13 are respectively provided on both end portions of the rotor body 10.

The seal portions 28 and 29 prevent steam flowing out from a portion between the rotary body 10 rotating around the axis O1 and the inner casing 3 or the outer casing 5. The seal portions 28 and 29 have the inner seal portion 28 which seals a portion between the inner casing 3 and the rotor body 10 and an outer seal portion 29 which seals a portion between the outer casing 5 and the rotor body 10.

The inner seal portion 28 seals a portion between the inner insertion hole 18 and the rotor body 10 which are provided in the inner casing 3 on the one side Da1 in the axial direction. The inner seal portion 28 performs sealing such that the steam S introduced via the inner introduction port 16 does not flow to the outside.

The outer seal portion 29 seals a portion between the rotor body 10 and the first outer insertion hole 25A and a portion between the rotor body 10 and the second outer insertion hole 26A. The outer seal portion 29 performs sealing such that the exhaust steam S2 does not flow to the outside from an internal space of the outer casing 5.

The upper valve 7 and the upper discharge port 23 are connected to each other by an upper pipe 37. In a state where the upper valve 7 is open, the exhaust steam S2 is discharged via the upper pipe 37. The lower valve 8 and the lower discharge port 24 are connected to each other by a lower pipe 38. In a state where the lower valve 8 is open, the exhaust steam S2 is discharged via the lower pipe 38.

In the present embodiment, the upper valve 7 and the lower valve 8 can be independently controlled. That is, the lower valve 8 can be closed while the upper valve 7 can be opened, or the lower valve 8 can be opened while the upper valve 7 can be closed. FIG. 1 shows the steam turbine 1 in a state where the upper valve 7 is closed and the lower valve 8 is open.

In addition, an opening degree of each of the upper valve 7 and the lower valve 8 can be freely controlled. That is, the upper valve 7 can be set to an opening degree of 80% and the lower valve 8 can be set to an opening degree of 10%.

As shown in FIG. 1, in the state where the upper valve 7 is closed, the exhaust steam S2 can be discharged through only the lower pipe 38. That is, the exhaust steam S2 positively flows to the lower casing 32 side, and thus, a temperature of the exhaust steam S2 is transmitted to the lower casing 32. In a case where the temperature of the exhaust steam S2 is higher than a temperature of the lower casing body 32A, the lower casing body 32A is heated. In a case where the temperature of the exhaust steam S2 is lower than the temperature of the lower casing body 32A, the lower casing body 32A is cooled.

As shown in FIG. 2, the steam turbine 1 has a casing temperature sensor 39 which measures a temperature of the outer casing body 20 and a flange portion temperature sensor 40 which measures a temperature of the flange portion 21.

A temperature Tc of the outer casing body 20 measured by the casing temperature sensor 39 is transmitted to the control unit 9. A temperature Tf of the flange portion 21 measured by the flange portion temperature sensor 40 is transmitted to the control unit 9.

Moreover, the steam turbine 1 has an exhaust steam temperature sensor 41 which measures the temperature of the exhaust steam S2.

Next, a control method of the steam turbine 1 according to the present embodiment will be described.

First, the following conditions are considered with respect to a control of the steam turbine 1.

(1) When Steam Turbine in Low Temperature State Start

The steam turbine 1 in a low temperature state is the steam turbine 1 which is not used for a long time. In the steam turbine 1 in the low temperature state, the outer casing 20 and the flange portion 21 each have a low temperature, and the temperatures of the outer casing body 20 and the flange portion 21 are substantially the same as each other.

A heat capacity of the outer casing body 20 is smaller than that of the flange portion 21, and thus, when the steam turbine 1 in the low temperature state starts, the outer casing body 20 is more easily warmed than the flange portion 21.

In addition, a rigidity of the outer casing body 20 is lower than that of the flange portion 21, and thus, when the steam turbine 1 in the low temperature state starts, a thermal elongation of the outer casing body 20 is large than that of the flange portion 21.

Figure 4:
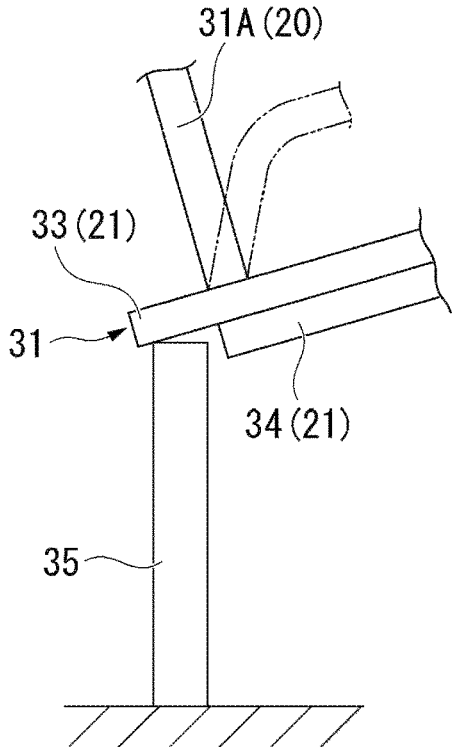
FIG. 4 is a schematic view explaining deformation when the steam turbine in a low temperature state starts.

Accordingly, a phenomenon shown in FIG. 4 is generated. As shown in FIG. 4, the outer casing body 20 is more largely deformed than the flange portion 21, and thus, a connection portion of the outer casing body 20 with respect to the flange portion 21 is deformed from a shape shown by dotted lines of FIG. 4 to shape shown by solid lines of FIG. 4. According to this deformation of the outer casing body 20, the flange portion 21 is also deformed as shown in FIG. 4. As shown in FIG. 4, according to this deformation, the upper half flange 33 is deformed such that a portion between support points is lifted upward from the support point by the frame 35.

In the case of the upper half flange support structure, the upper half flange 33 is deformed in this way, and thus, the outer casing body 20 moves upward. The outer casing body 20 moves upward, and thus, the inner casing 3 fixed to the outer casing 5 also moves upward, and the gaps CL1 and CL2 are inadvertently narrowed. Specifically, the gaps CL1 and CL2 of the rotor blades 6 and the stator vanes 4 below the axis O1 of the stream turbine 1 are narrowed.

(2) When Steam Turbine in High Temperature is Stopped from Rated Operation

The steam turbine 1 is a high temperature state is the steam turbine 1 during a rated operation. In the steam turbine 1 in the high temperature state, the outer casing 20 and the flange portion 21 each have a high temperature, and the temperatures of the outer casing body 20 and the flange portion 21 are substantially the same as each other.

The heat capacity of the outer casing body 20 is smaller than that of the flange portion 21, and thus, when the steam turbine 1 in the high temperature state stops from the related operation, the outer casing body 20 is more easily cooled than the flange portion 21.

In addition, the rigidity of the outer casing body 20 is lower than that of the flange portion 21, and thus, when the steam turbine 1 in the high temperature state stops from the related operation, a thermal shrinkage of the outer casing body 20 is large than that of the flange portion 21.

Accordingly, contrary to the phenomenon shown in FIG. 4, the upper half flange 33 is deformed such that a portion between support points is lifted downward from the support point by the frame 35. In this way, the upper half flange 33 is deformed, and thus, the outer casing body 20 moves downward. The outer casing body 20 moves downward, and thus, the inner casing 3 fixed to the outer casing 5 also moves downward, and the gaps CL1 and CL2 are inadvertently narrowed. Specifically, the gaps CL1 and CL2 of the rotor blades 6 and the stator vanes 4 above the axis O1 of the stream turbine 1 are narrowed.

(3) During Rated Operation

During the related operation, the temperatures of the outer casing body 20 and the flange portion 21 are substantially the same as each other. That is, the thermal elongation of the outer casing body 20 and the thermal elongation of the flange portion 21 are substantially the same as each other, and the gaps CL1 and CL2 are normal.

In the steam turbine 1 of the present embodiment, (1) when the steam turbine 1 in the low temperature state starts and (2) when the steam turbine 1 in the high temperature state stops from the rated operation, as shown in FIG. 1, the upper valve 7 is closed and the lower valve 8 is opened. That is, in the upper portion (upper casing 31 side) and the lower portion (lower casing 32 side) of the outer casing 5, the upper valve 7 and the lower valve 8 are controlled such that more exhaust steam S2 flows to the lower portion side.

Here, while the steam turbine 1 starts, the temperature of the exhaust steam S2 is higher than a predetermined temperature. For example, the predetermined temperature is the temperature of the outer casing body 20.

Accordingly, (1) when the steam turbine 1 in the low temperature state starts, a high temperature exhaust steam S2 while the steam turbine 1 starts flows to the lower casing 32 side. Therefore, the lower casing body 32A is expanded by the thermal elongation. Accordingly, the lower gaps CL1 and CL2 of the steam turbine 1 are prevented from being narrowed.

In addition, (2) when the steam turbine 1 in the high temperature state stops from the rated operation, a low temperature steam S1 flows to the lower casing 32 side while the steam turbine 1 stops. The low temperature is a temperature which is lower than the predetermined temperature. Accordingly, the lower casing body 32A is shrunk by the thermal shrinkage. Accordingly, the upper gaps CL1 and CL2 of the steam turbine 1 are prevented from being narrowed.

Moreover, (3) during the related operation, the upper valve 7 and the lower valve 8 are open. Accordingly, the exhaust steam S2 is supplied to the upper portion and the lower portion of the steam turbine 1 in a well-balanced manner.

According to the embodiment, by closing only one of the upper valve 7 and the lower valve 8, lots of exhaust steam S2 flows to one of the upper portion and the lower portion of the second main flow path 12. More exhaust steam S2 having a high temperature or a low temperature flows to the upper portion and the lower portion of the second main flow path 12 according to an operation condition of the steam turbine 1, and thus, the deformation of the outer casing 5 is promoted, and each of the gaps CL1 and CL2 between the rotor 2 and the inner casing 3 can be an appropriate value.

Figure 5:
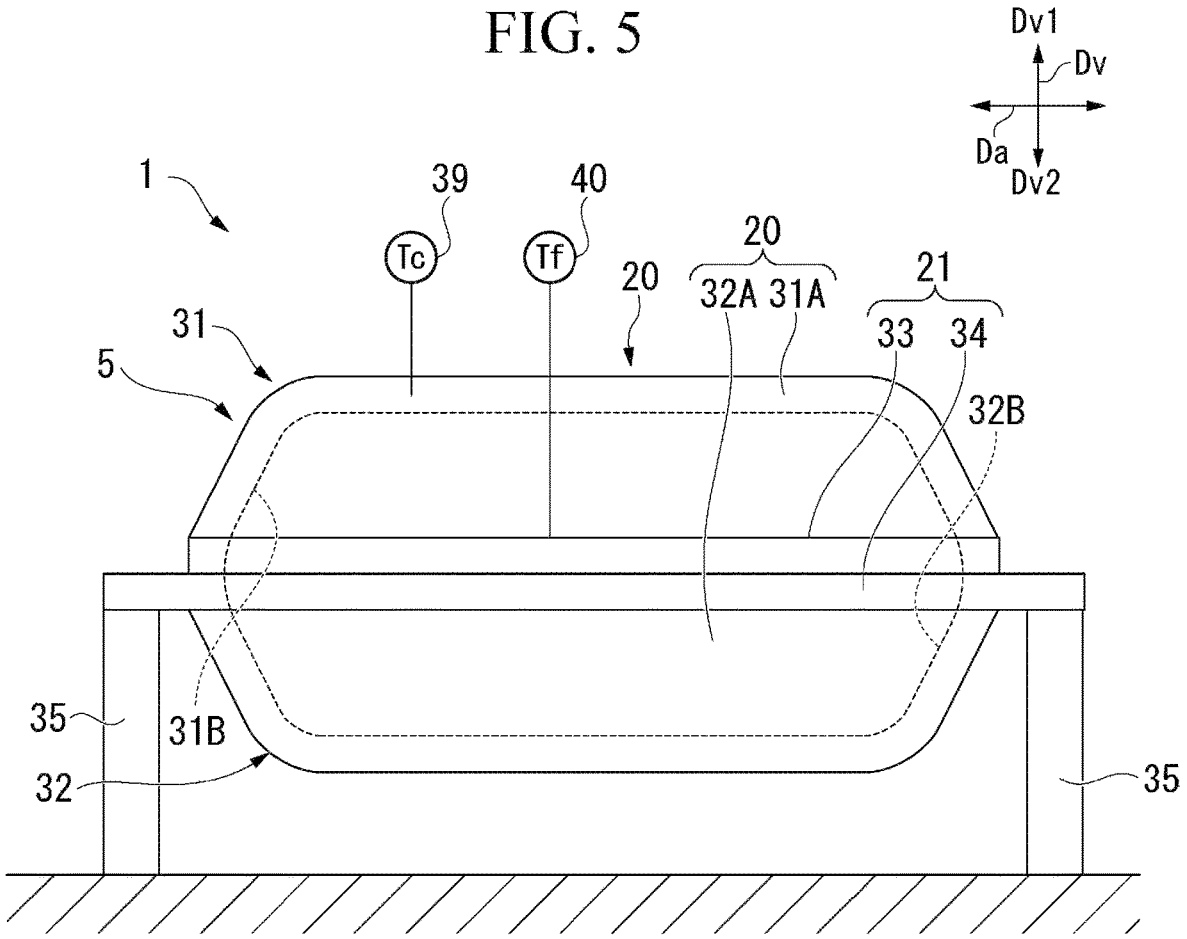
FIG. 5 is a side view showing a configuration and a support structure of an outer casing of a steam turbine in a modification example of the first embodiment of the present invention.

In addition, the flange portion 21 of the present embodiment is the upper half flange support structure in which the upper half flange 33 is large and the upper half flange 33 is supported by the frame 35. However, as shown in FIG. 5, the lower half flange 34 may be larger than the upper half flange 33 and the lower half flange 34 may be supported by the frame 35. Hereinafter, this support method is referred to as a lower half flange support and this structure is referred to as a lower half flange support structure.

In a case of the lower half flange support, (1) when the steam turbine 1 in the low temperature state starts, the lower half flange 34 is deformed such that a portion between the support points is lifted downward from the support point of the frame 35. In this way, the lower half flange 34 is deformed, and thus, the outer casing body 20 moves downward. Accordingly, the gaps CL1 and CL2 of the rotor blades 6 and the stator vanes 4 above the axis O1 of the steam turbine 1 are narrowed.

Moreover, in the case of the lower half flange support, (2) when the steam turbine 1 in the high temperature state stops from the rated operation, the lower half flange 34 is deformed such that a portion between the support points is lifted upward from the support point of the frame 35.

Figure 6:
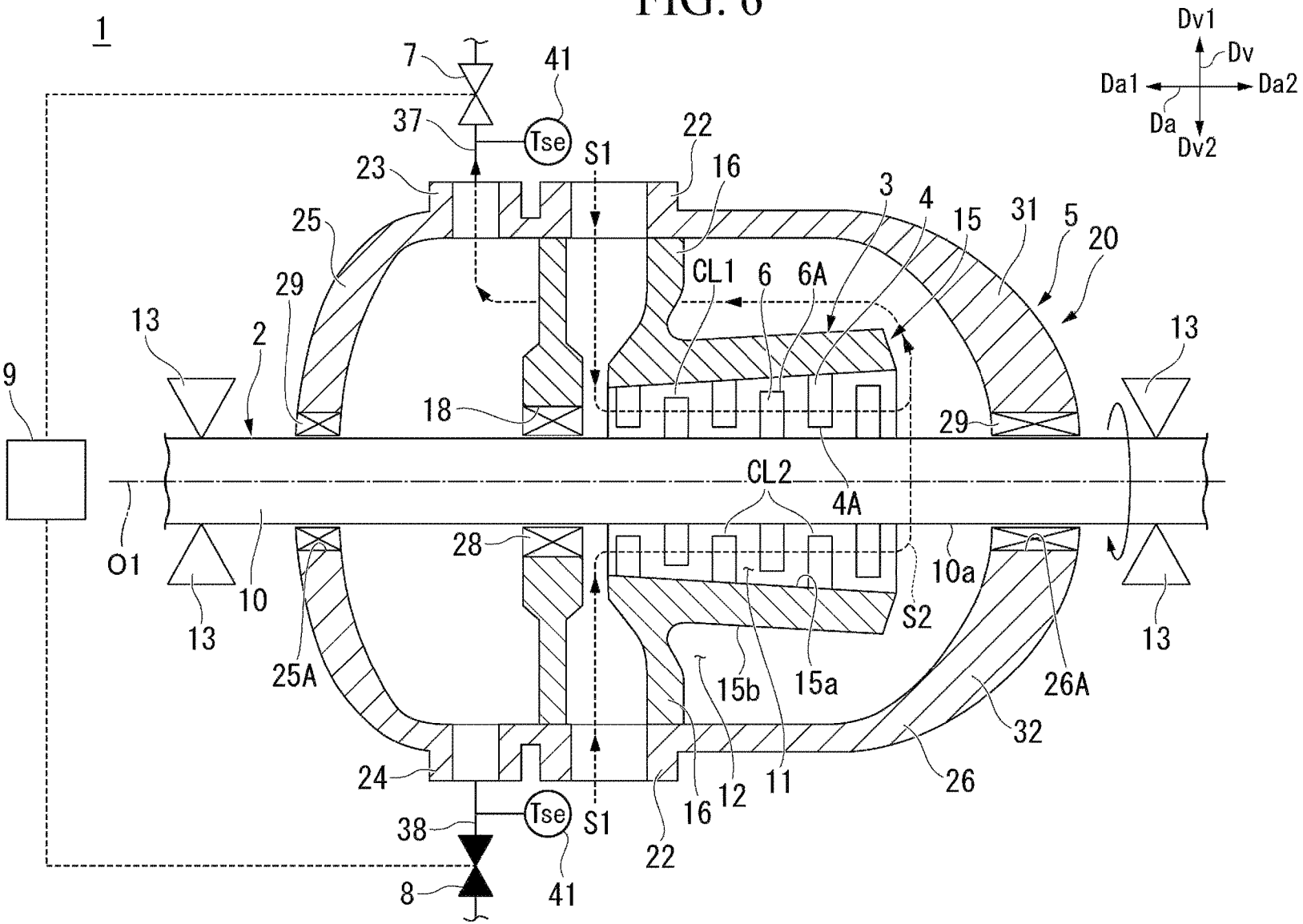
FIG. 6 is a sectional view showing a state in which only an upper valve is opened and lots of exhaust steam flows to an upper casing side.

In a case where the steam turbine 1 is the lower half flange support structure, as shown in FIG. 6, when (1) the stream turbine 1 in the low temperature state starts and (2) the steam turbine 1 in the high temperature state stops, the control unit 9 of the steam turbine 1 opens the upper valve 7 and closes the lower valve 8.

Accordingly, (1) the stream turbine 1 in the low temperature state starts, the exhaust steam S2 having a high temperature flows to the upper casing 31 side while the steam turbine 1 starts. Accordingly, the upper casing body 31A is expanded by thermal elongation. Therefore, the upper gaps CL1 and CL2 of the steam turbine 1 are prevented from being narrowed.

In addition, (2) when the steam turbine 1 in the high temperature state stops from the rated operation, the exhaust steam S2 having a low temperature flows to the upper casing 31 side while the steam turbine 1 stops. Accordingly, the upper casing body 31A is shrunk by the thermal shrinkage. Accordingly, the lower gaps CL and CL2 of the steam turbine 1 are prevented from being narrowed.

As described above, in the present embodiment, in the case where the temperature of the exhaust steam S2 is higher than the predetermined temperature, the control unit 9 of the steam turbine 1 controls the upper valve 7 and the lower valve 8 such that more exhaust steam S2 flows to a portion, which moves to the rotor 2 side according to the deformation of the flange portion 21, of the upper portion and the lower portion of the outer casing 5.

In addition, in the case where the temperature of the exhaust steam S2 is lower than the predetermined temperature, the control unit 9 of the steam turbine controls the upper valve 7 and the lower valve 8 such that more exhaust steam S2 flows to a portion opposite to the portion, which moves to the rotor 2 side according to the deformation of the flange portion 21, of the upper portion and the lower portion of the outer casing 5.

Figure 7:
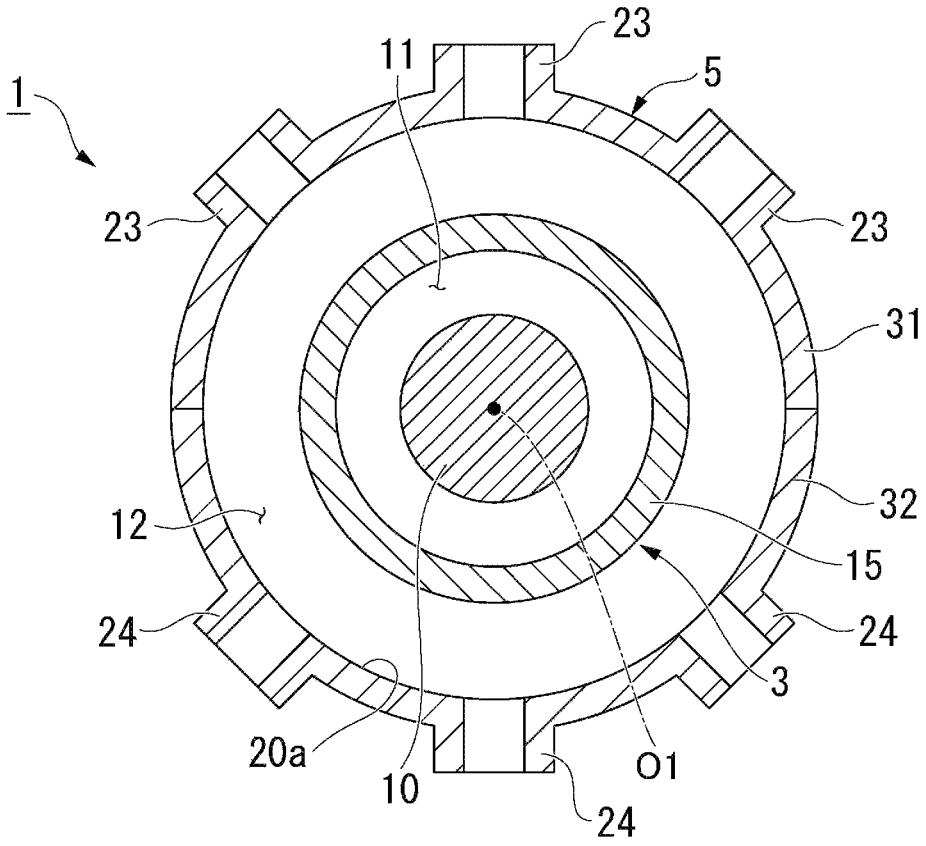
FIG. 7 is a view corresponding to FIG. 3 and is a sectional view of a steam turbine of a modification example of the first embodiment of the present invention.

Moreover, in the present embodiment, the two upper discharge ports 23 and the two lower discharge ports 24 are provided. However, the present invention is not limited to this. For example, as shown in FIG. 7, three upper discharge ports 23 may be provided in the upper casing 31 and three lower discharge ports 24 may be provided in the lower casing 32. In addition, although not shown, one upper discharge port 23 may be provided in the upper casing 31 and one lower discharge port 24 may be provided in the lower casing 32. In addition, the number of the upper discharge ports 23 and the number of the lower discharge ports 24 may be different from each other. For example, two upper discharge ports 23 and three lower discharge ports 24 may be provided.

In addition, in the embodiment, each of the opening degree of the upper valve 7 and the opening degree of the lower valve 8 is an opening degree (fully open) of 100% or an opening degree (fully close) of 0%. However, the opening degree of the valve need not necessarily be the fully open or the fully close.

That is, when it is desired to heat the upper casing body 31A side, more exhaust steam S2 may flow to the upper casing body 31A side. In other words, instead of the upper valve 7 being opened and the lower valve 8 being closed, the opening degree of the upper valve 7 may be set to 100% and the opening degree of the lower valve 8 may be set to 20%.

Second Embodiment

Hereinafter, a steam turbine 1B of a second embodiment of the present invention will be described in detail with reference to the drawings. In addition, in the present embodiment, differences between the present embodiment and the above-described first embodiment will be mainly described and descriptions of similar portions will be omitted.

Figure 8:
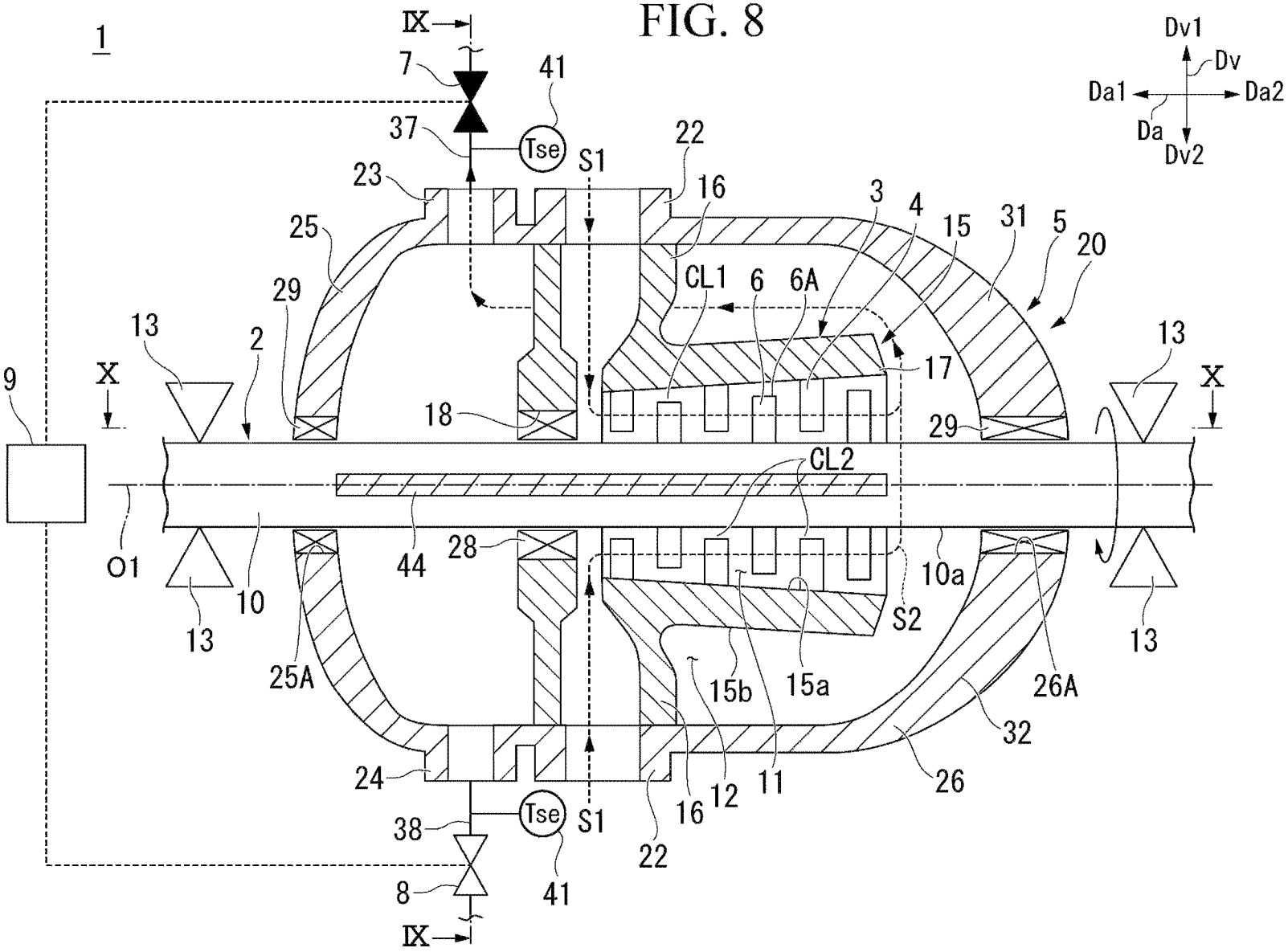
FIG. 8 is a sectional view showing a configuration of a steam turbine of a second embodiment of the present invention.
Figure 9:
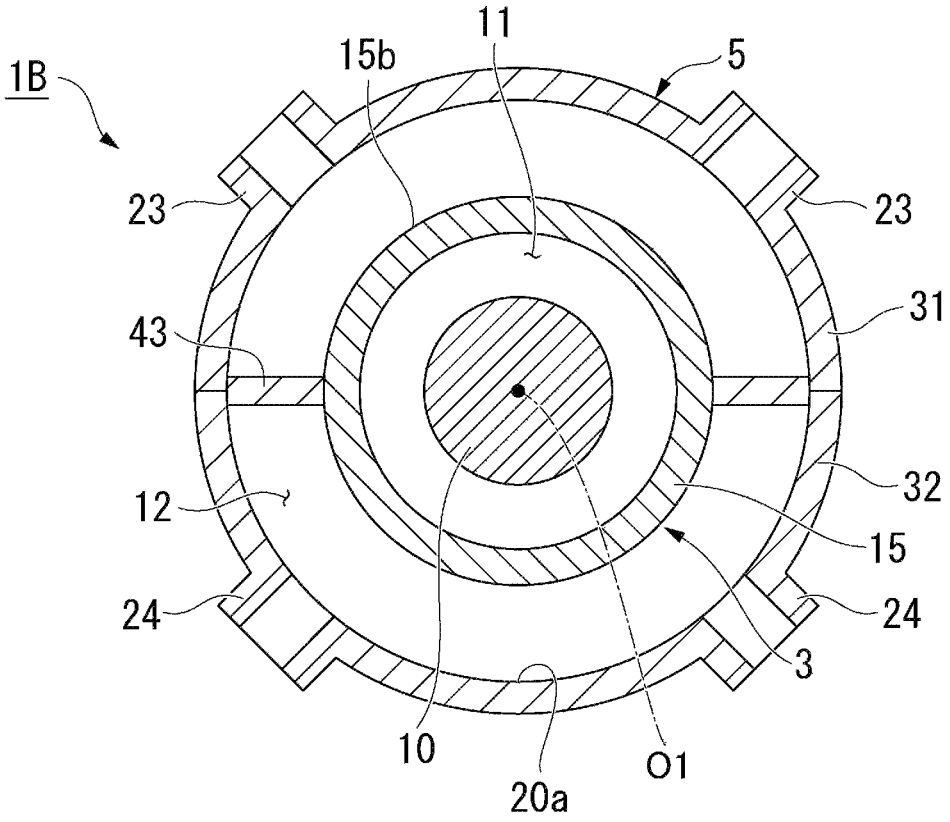
FIG. 9 is a sectional view taken along line IX-IX of FIG. 8 and is a sectional view explaining a closing plate of the steam turbine of the second embodiment of the present invention.
Figure 10:
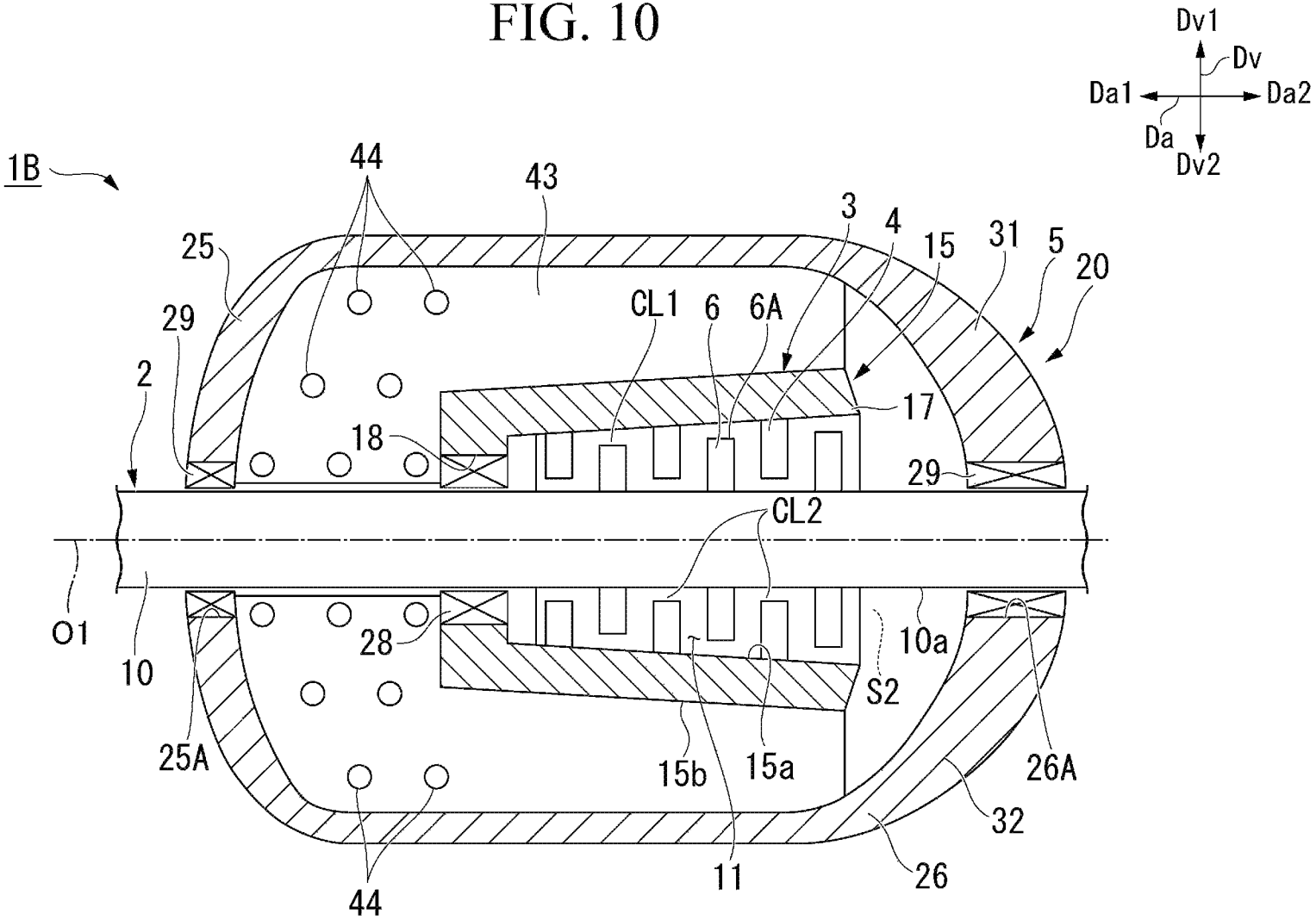
FIG. 10 is a sectional view taken along line X-X of FIG. 8 and is a sectional view explaining the closing plate of the steam turbine of the second embodiment of the present invention.

As shown in FIGS. 8, 9, and 10, the steam turbine 1B of the present embodiment has a closing plate 43 which is a flat plate-shaped member which is formed over the outer peripheral surface 15*b* of the inner casing body 15 and the inner peripheral surface 20*a* of the outer casing body 20. The closing plate 43 is formed so as to divide the second main flow path 12 vertically.

The closing plate 43 is not formed on the other side Da2 in the axial direction from an end portion of the inner casing 3 on the other side Da2 in the axial direction. That is, the closing plate 43 is formed so as not to obstruct a flow in the upward-downward direction Dv of the steam S1 discharged from the first main flow path 11.

In addition, a plurality of holes 44 are formed in the closing plate 43. The holes 44 are formed on the one side Da1 in the axial direction from the end portion of the inner casing 3 on the one side Da1 in the axial direction. The formation positions of the holes 44 are not limited to the above-described positions. A formation range of the holes 44 can be appropriately adjusted. For example, the holes 44 can be formed on the entire surface of the closing plate 43. In addition, the holes 44 is not necessarily formed.

In the embodiment, it is possible to reliably switch the flow of the exhaust steam S2 of the steam turbine 1 by switching between the upper valve 7 and the lower valve 8. In addition, the holes 44 are formed in the closing plate 43, and thus, in a case where the flows of the upper and lower exhaust steam S2 being completely closed is inappropriate, a portion of the exhaust steam S2 can flow appropriately.

Third Embodiment

Hereinafter, a steam turbine 1C of a third embodiment of the present invention will be described in detail with reference to the drawings. In addition, in the present embodiment, differences between the present embodiment and the above-described first embodiment will be mainly described and descriptions of similar portions will be omitted.

Figure 11:
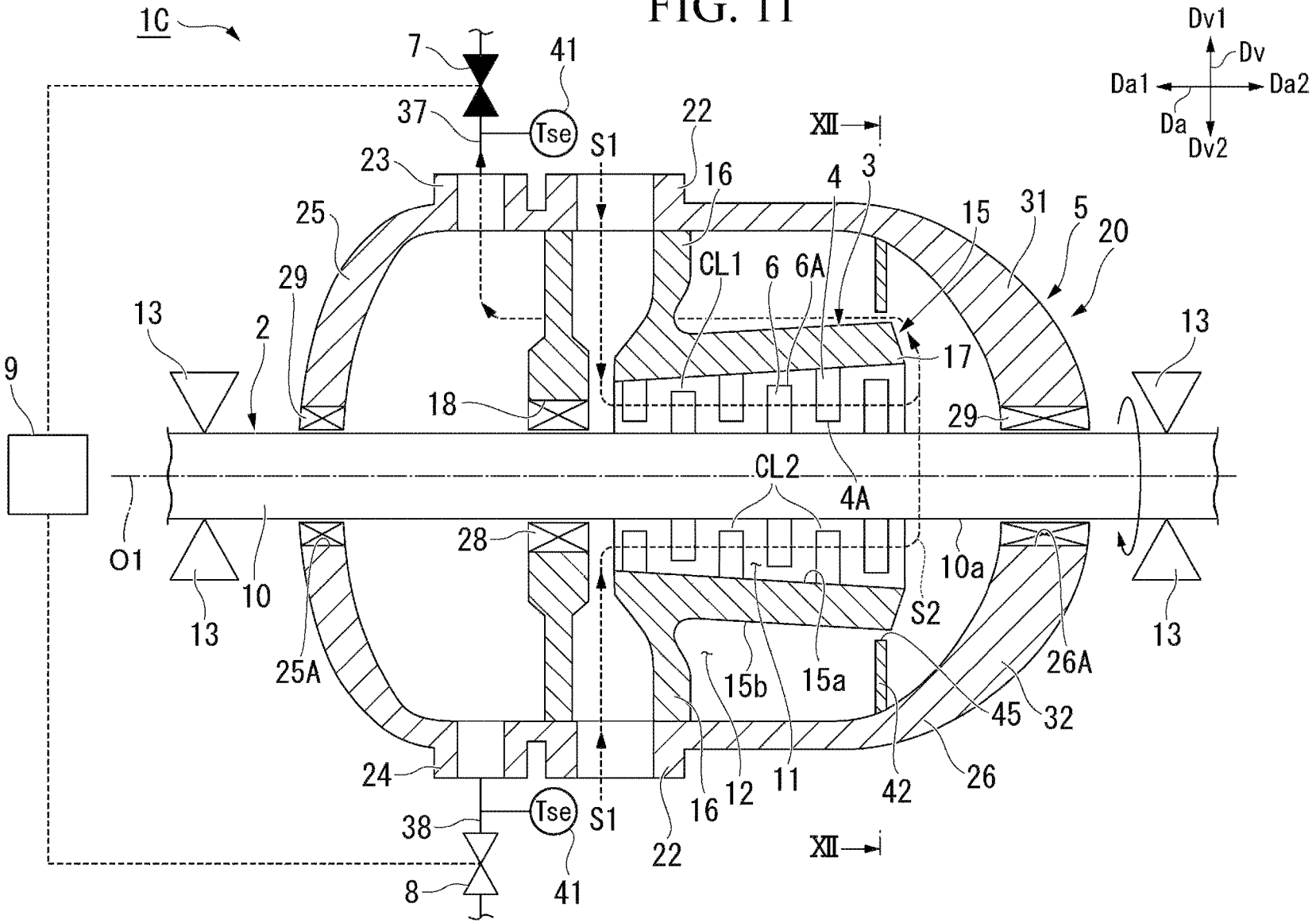
FIG. 11 is a sectional view showing a configuration of a steam turbine of a third embodiment of the present invention.
Figure 12:
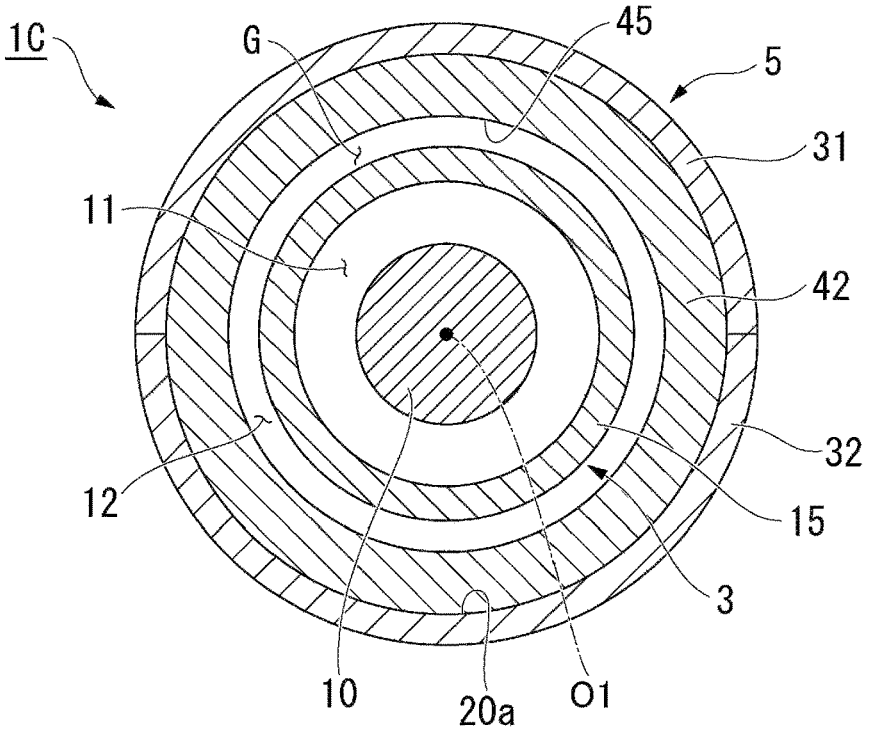
FIG. 12 is a sectional view taken along line XII-XII of FIG. 11 and a sectional view explaining a baffle plate of the steam turbine of the third embodiment of the present invention.

As shown FIGS. 11 and 12, the steam turbine 1C of the present embodiment has a baffle plate 42 which is formed in a plate shape having a main plane orthogonal to the axis O1.

A position of the baffle plate 42 in the axial direction Da is substantially the same as a position of the end portion of the inner casing 3 on the other side Da2 in the axial direction. The baffle plate 42 is a disk-shaped member in which a baffle plate through-hole 45, into which the rotor 2 and the inner casing 3 are inserted, is formed on the inside in the radial direction. A predetermined gap G is formed between the baffle plate through-hole 45 and the inner casing 3.

According to the embodiment, the exhaust steam S2 flows through the narrow gap G, and thus, the flow of the exhaust steam S2 is more uniform in the circumferential direction. Accordingly, it is possible to prevent unevenness from occurring in a flow rate of the exhaust stream S2 in the circumferential direction.

Figure 13:
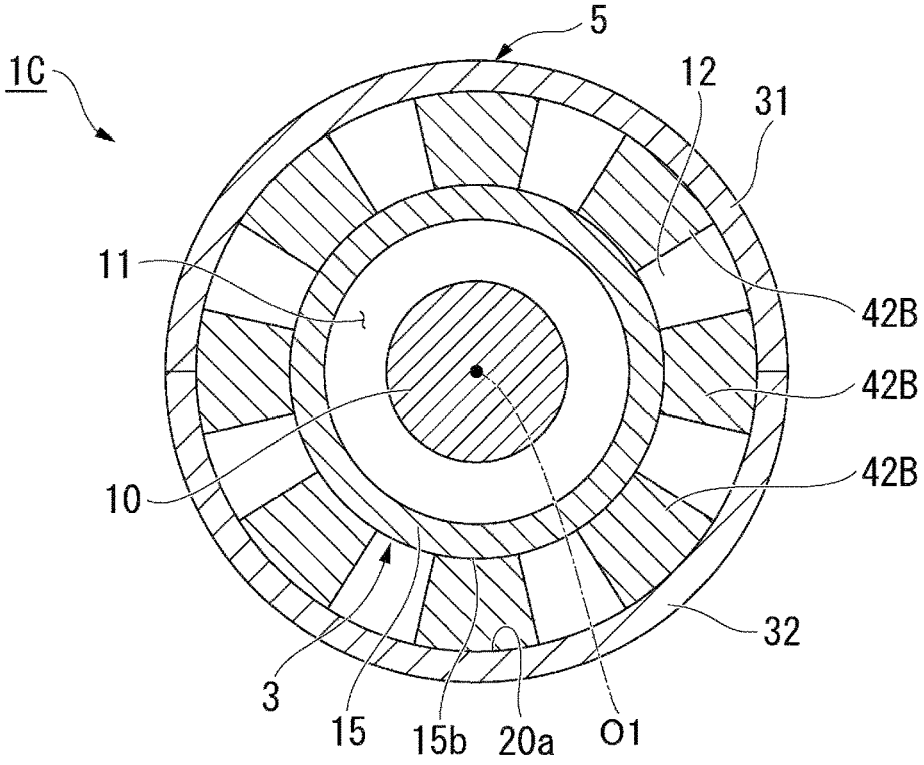
FIG. 13 is a sectional view explaining a modification example of the baffle plate of the steam turbine in the third embodiment of the present invention.

In addition, the shape of the baffle plate 42 is not limited to the shape shown in FIG. 12. For example, as shown in FIG. 13, a plurality of second baffle plates 42B each having a small circumferential width may be formed over the outer peripheral surface 15*b* of the inner casing 3 and the inner peripheral surface 20*a* of the outer casing 5. The plurality of second baffle plates 42B are provided at equal intervals in the circumferential direction.

According to this aspect, the unevenness of the flow rate of the exhaust steam S2 is generated at locations at which the second baffle plates 42B exist and locations at which the second baffle plates 42B do not exist. However, in a large range in the entire circumferential direction, the unevenness of the flow rate of the exhaust steam S2 is suppressed.

Figure 14:
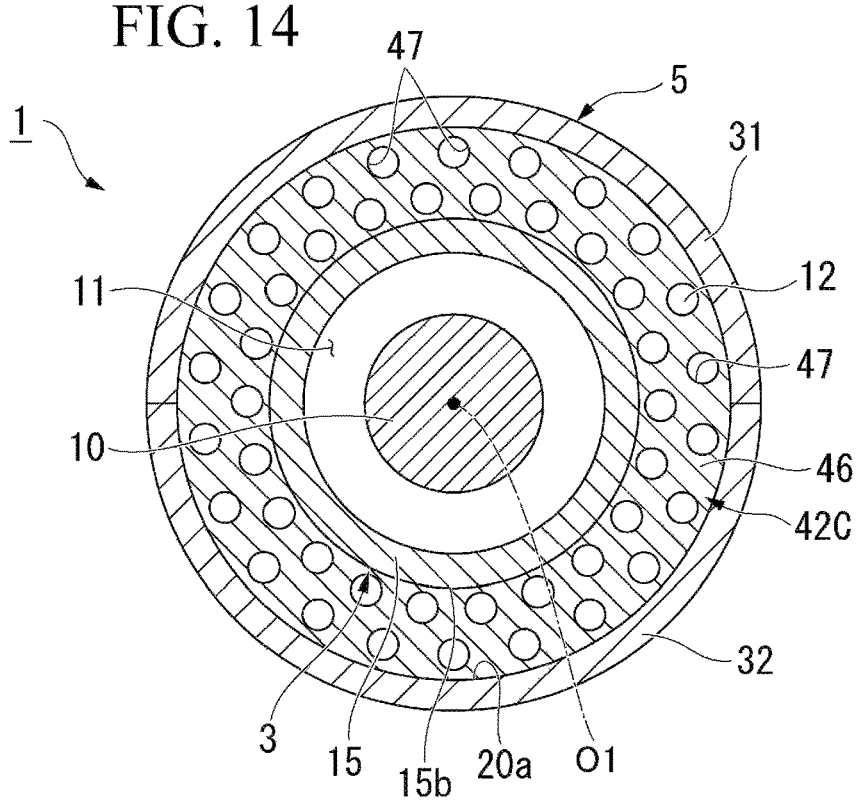
FIG. 14 is a section view explaining a modification example of the baffle plate of the steam turbine in the third embodiment of the present invention.
Figure 15:
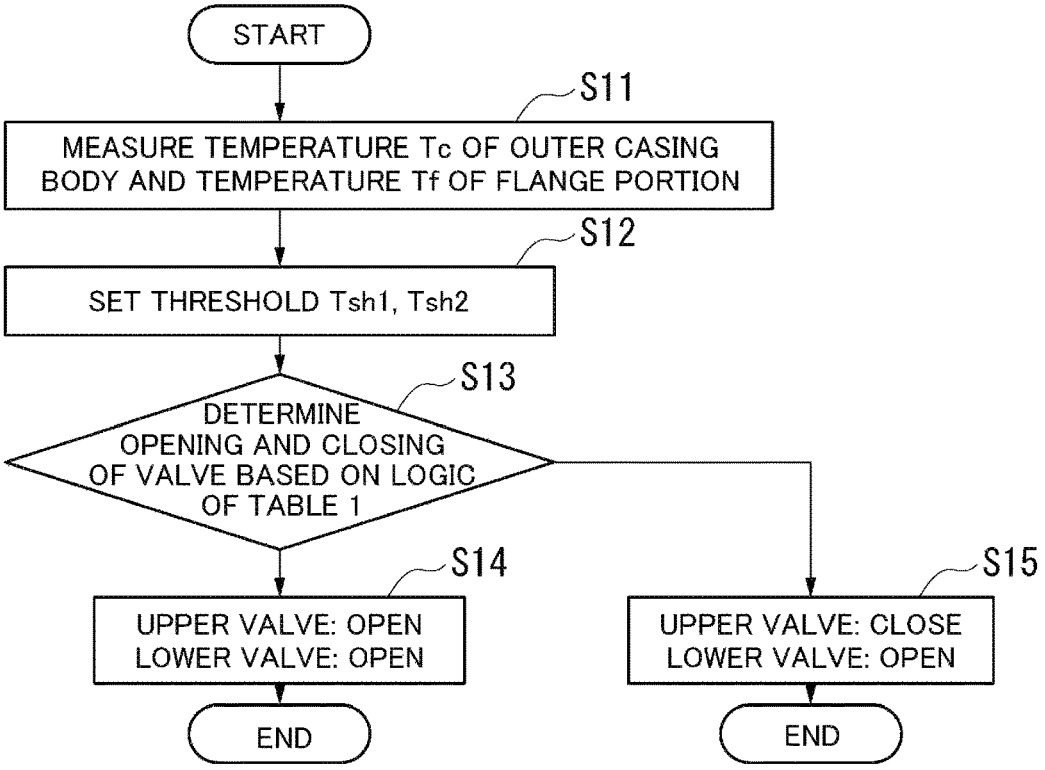
FIG. 15 is a flowchart explaining a steam turbine control method of a fourth embodiment of the present invention.
Figure 16:
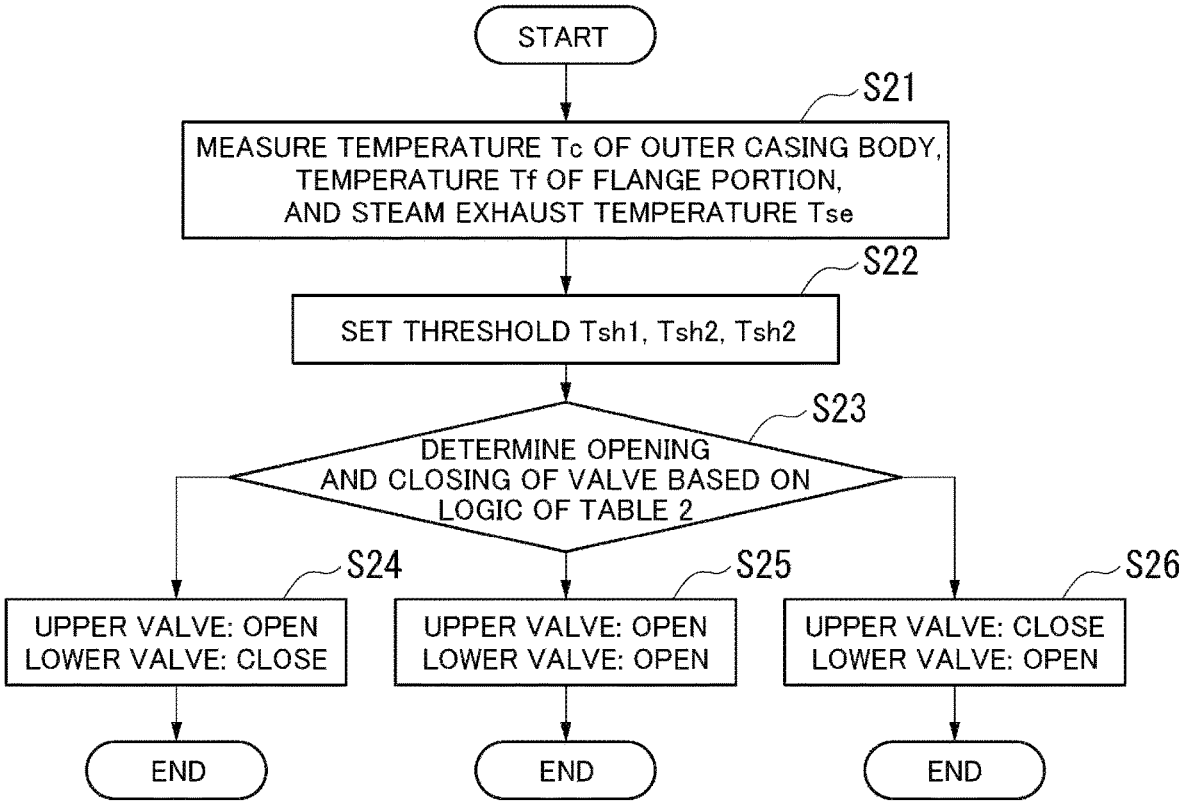
FIG. 16 is a flowchart explaining a steam turbine control method of a fifth embodiment of the present invention.

In addition, as shown in a third baffle plate 42C shown in FIG. 14, the gap G is formed by the plurality of baffle plate holes 47. The third baffle plate 42C has a baffle plate body portion 46 which is formed over the outer peripheral surface of the inner casing 3 and the inner peripheral surface of the outer casing 5 and baffle plate holes 47 which are uniformly formed in the baffle plate body portion 46. The third baffle plate 42C may be formed of a punching metal (punching plate). A shape of each baffle plate hole 47 is not limited to a circle.

Fourth Embodiment

Hereinafter, a steam turbine of a fourth embodiment of the present invention will be described in detail with reference to the drawings. In addition, in the present embodiment, differences between the present embodiment and the above-described first embodiment will be mainly described and descriptions of similar portions will be omitted.

In the present embodiment, the control unit 9 controls the upper valve 7 and the lower valve 8 based on conditions shown in Table 1 with reference to the temperature Tc of the outer casing body 20 and the temperature Tf of the flange portion 21.

TABLE 1

| | High and low of metal temperature | Upper valve | Lower valve |
|---|---|---|---|
| Upper half flange support | Tc-Tf < Tsh1 | close | open |
| | Tsh1 ≤ Tc-Tf ≤ Tsh2 | open | open |
| | Tsh2 < Tc-Tf | close | open |
| Lower half flange support | Tc-Tf < Tshl | open | close |
| | Tsh1 ≤ Tc-Tf ≤ Tsh2 | open | open |
| | Tsh2 < Tc-Tf | open | close |

In the present embodiment, the control unit 9 compares a value (Tc−Tf) obtained by subtracting the temperature Tf of the flange portion 21 from the temperature Tc of the outer casing body 20 with a threshold Tsh1 and a threshold Tsh2 of a temperature, and performs controls of opening and closing of the upper valve 7 and the lower valve 8. In addition, a position at which the temperature Tc of the outer casing body 20 is measured may be the upper casing 31 or the lower casing 32. Moreover, a position at which the temperature Tf of the flange portion 21 is measured may be the upper half flange 33 or the lower half flange 34.

Next, setting methods of the threshold Tsh1 and the threshold Tsh2 of the temperature will be described. The threshold Tsh2 of the temperature is a value higher than the threshold Tsh1.

Preferably, the threshold differs depending on various conditions such as a structure of the steam turbine 1, dimensions of each portion of the steam turbine 1, a steam pressure, or a temperature. The threshold is set by adding a margin for a manufacturing error and a prediction error to prediction values of minimum gaps CL1 and CL2 during the operation (including a transition such as at the time of start or at the time of stop) of the steam turbine 1 in order to prevent a contact between a stationary portion (inner casing 3 and the stator vane 4) and a rotary portion (rotor 2). For example, examples of a method and a result of the prediction of the gap at the time of the transition are described in (i) Brilliant, H. M., AND Tolpadi, a. K., "ANALYTICAL APPROACHTO STEAM TURBINE HEAT TRANSFER IN a COMBINED CYCLE POWER PLANT", ASME-Paper GT2004-53387; and (ii) Quinkertz, R., Thiemann, T., AND Gierse, K., "VALIDATION OF ADVANCED STEAM TURBINE TECHNOLOGY—a CASE STUDY OF AN ULTRA SUPER CRITICAL STEAM TURBINE POWER PLANT", ASME Paper GT2011-45816, and thus, a person skilled in the art can predict the gap with reference to the method and result.

The control method of the steam turbine 1 of the present embodiment will be described.

The control method of the steam turbine 1 includes a measurement step S11 of measuring the temperature Tc of the outer casing body 20 and the temperature Tf of the flange portion 21, a threshold setting step S12 of setting the thresholds Tsh1 and Tsh2, and a determination step S13 of determining opening and closing of the valve based on a logic of Table 1, and valve control steps S14 and S15. In the measurement step S11, the temperature Tc of the outer casing body 20 measured by the casing temperature sensor 39 and the temperature Tf of the flange portion 21 measured by the flange portion temperature sensor 40 are transmitted to the control unit 9.

In the threshold setting step S12, the thresholds Tsh 1 and Tsh 2 are set based on the structure of the steam turbine 1 or the like.

In the determination step S13, the opening and closing of the upper valve 7 and the lower valve 8 are determined based on the logic described in Table 1. Here, the case where the steam turbine 1 is the upper half flange support structure will be described. In the case where the steam turbine 1 is the upper half flange support structure, when the steam turbine 1 starts, the outer casing 5 is lifted upward and the lower gaps CL1 and CL 2 of the steam turbine 1 decrease. In addition, in the case where the steam turbine 1 is the upper half flange support structure, when the steam turbine 1 stops from the rated operation of the steam turbine 1, the outer casing 5 moves downward and the upper gaps CL1 and CL 2 of the steam turbine 1 decrease.

The control unit 9 compares the value (Tc−Tf) obtained by subtracting Tf from Tc with the threshold Tsh1 and the threshold Tsh 2. In case where Tc−Tf is smaller than threshold Tsh1 (Tc−Tf<Tsh1), that is, in a case where the temperature of flange portion 21 is higher than the temperature of the outer casing body 20 and the steam turbine 1 stops from the rated operation, the upper valve 7 is closed and the lower valve 8 is opened. That is, the upper valve 7 and the lower valve 8 are controlled such that more exhaust steam S2 flows to the lower casing body 32A side of the upper casing body 31A and the lower casing body 32A. As a result, the exhaust steam S2 having a low temperature shrinks the lower casing body 32A. Accordingly, the upper gaps CL 1 and CL2 of the steam turbine 1 are prevented from being narrowed.

In a case where Tc−Tf is equal to or larger than the threshold Tsh1 and equal to or smaller than the threshold Tsh 2 (Tsh1≤Tc−Tf≤Tsh 2), that is, in a case where the temperature of the flange portion 21 and the temperature of the outer casing body 20 are close to each other, the upper valve 7 and the lower valve 8 are opened. As a result, the exhaust steam S2 flows evenly to the upper and lower portions of the steam turbine 1.

In a case where Tc−Tf is larger than the threshold Tsh1 (Tsh 2<Tc−Tf), that is, in a case where the temperature Tc of the outer casing body 20 is higher than the temperature of the flange portion 21 and the steam turbine 1 starts, the upper valve 7 is closed and the lower valve 8 is opened. That is, the upper valve 7 and the lower valve 8 are controlled such that more exhaust steam S2 flows to the lower casing body 32A side of the upper casing body 31A and the lower casing body 32A. As a result, the exhaust steam S2 having a high temperature expands the lower casing body 32A. Accordingly, only the lower gaps CL1 and CL2 of the steam turbine 1 are prevented being narrowed.

In the control method of the steam turbine 1, the above-described processing is repeated (returning to start after end) or is performed at constant time intervals.

In addition, in a case where the stream turbine 1 is the lower half flange 34 support structure, similarly, the control is performed according to the logic of Table 1.

According to the embodiment, a more accurate control is possible by performing the control with reference to the temperature of each portion.

Fifth Embodiment

Hereinafter, a steam turbine of a fifth embodiment of the present invention will be described in detail with reference to the drawings. In addition, in the present embodiment, differences between the present embodiment and the above-described fourth embodiment will be mainly described and descriptions of similar portions will be omitted.

In the steam turbine 1 of the present embodiment, the control unit 9 performs the control with reference to the temperature of the exhaust steam S2.

In the present embodiment, the control unit 9 controls the upper valve 7 and the lower valve 8 based on conditions shown in Table 2 with reference to the temperature Tc of the outer casing body 20, the temperature Tf of the flange portion 21, and the temperature Tse of the exhaust steam S2.

TABLE 2

| | High and low of metal temperature | Relationship between exhaust steam temperature and metal temperature | Upper valve | Lower valve |
|---|---|---|---|---|
| Upper half flange support | Tc-Tf < Tsh1 | Tc-Tse < Tsh3 | open | close |
| | | Tc-Tse ≥ Tsh3 | close | open |
| | Tsh1 ≤ Tc-Tf ≤ Tsh2 | Tc-Tse < Tsh3 | open | open |
| | | Tc-Tse ≥ Tsh3 | open | open |
| | Tsh2 < Tc-Tf | Tc-Tse < Tsh3 | close | open |
| | | Tc-Tse ≥ Tsh3 | open | close |
| Lower half flange support | Tc-Tf < Tsh1 | Tc-Tse < Tsh3 | close | open |
| | | Tc-Tse ≥ Tsh3 | open | close |
| | Tsh1 ≤ Tc-Tf ≤ Tsh2 | Tc-Tse < Tsh3 | open | open |
| | | Tc-Tse ≥ Tsh3 | open | open |
| | Tsh2 < Tc-Tf | Tc-Tse < Tsh3 | open | close |
| | | Tc-Tse ≥ Tsh3 | close | open |

In addition to the control of the steam turbine of the fourth embodiment, the control unit 9 of the present embodiment compares the value (Tc−Tse) obtained by subtracting the temperature Tse of the exhaust steam S2 from the temperature Tc of the outer casing body 20 and a threshold Tsh3 of the temperature and controls the opening and closing of the upper valve 7 and the lower valve 8 according to the result.

The threshold Tsh 3 of the temperature can be set based on an intermediate temperature between a highest temperature of the temperatures of the exhaust steam S2 and a lowest temperature of the temperatures of the exhaust steam S2, or the like.

Moreover, preferably, a measurement position of the temperature Tse of the exhaust steam S2 is the inside the outer casing 5 rather than the outside of the outer casing 5 shown in the drawings. In a case where the temperature Tse of the exhaust steam S2 is measured outside the outer casing 5, the threshold Tsh3 is set in consideration of heat escape or the like after the exhaust steams S2 is discharged from the outer casing 5.

The control method of the steam turbine of the present embodiment will be described.

In the present embodiment, the control method of the steam turbine includes a measurement step S21 of measuring the temperature Tc of the outer casing body 20, the temperature Tf of the flange portion 21, and the temperature Tse of the exhaust steam S2, a threshold setting step S22 of setting the thresholds Tsh1, Tsh 2, and Tsh3, and a determination step S23 of determining opening and closing of the valve based on a logic of Table 2, and valve control steps S24, S25, and S26.

Here, particularly, the determination step S23 will be described. In the determination step S23 of the present embodiment, in addition to the determination step S13 of the fourth embodiment, whether or not Tc−Tse is smaller than Tsh3 (Tc−Tse<Tsh3) or whether or not Tc−Tse is equal to or more than Tsh3 (Tc−Tse≥Tsh3) is added as a determination criteria.

Tc−Tse is smaller than Tsh 3 means that the temperature Tse of the exhaust steam S2 is higher than the predetermined temperature. Accordingly, the exhaust steam S2 is used for heating the upper casing body 31A or the lower casing body 32A.

Tc−Tse is equal to or more than Tsh3 means that the temperature Tse of the exhaust steam S2 is lower than the predetermined temperature. Therefore, the exhaust steam S2 is used for cooling the upper casing body 31A or the lower casing body 32A.

In the control method of the steam turbine, the above-described processing is repeated (returning to start after end) or is performed at constant time intervals. In addition, in the case where the stream turbine 1 is the lower half flange 34 support structure, similarly, the control is performed according to the logic of Table 2.

According to the embodiment, by adding the temperature Tse of the exhaust steam S2 as the determination criteria, in addition to the effects of the steam turbine of the fourth embodiment, even in case where the temperature Tse of the exhaust steam S2 is different from an assumed value due to switching of an operating state or the like, an accurate control can be performed.

Sixth Embodiment

Hereinafter, a steam turbine 1F of a sixth embodiment of the present invention will be described in detail with reference to the drawings. In addition, in the present embodiment, differences between the present embodiment and the above-described first embodiment will be mainly described and descriptions of similar portions will be omitted.

Figure 17:
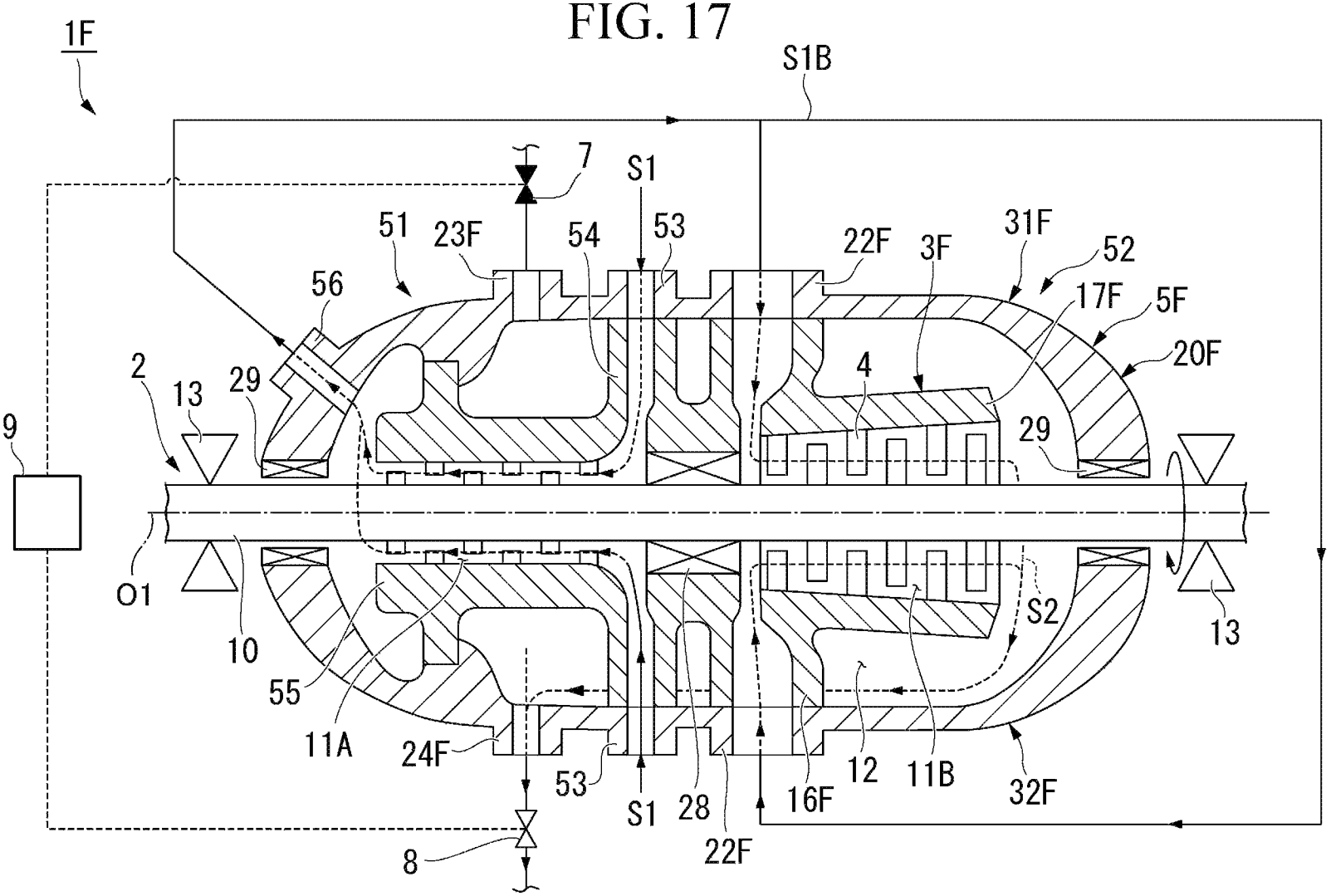
FIG. 17 is a sectional view showing a configuration of a steam turbine of a sixth embodiment of the present invention.

As shown FIG. 17, the steam turbine 1F of the present embodiment is a steam turbine in which a high pressure turbine 51 and an intermediate pressure turbine 52 are integrated with each other.

The steam turbine 1F of the present embodiment has the high pressure turbine 51 and the intermediate pressure turbine 52. In the present embodiment, a high pressure turbine main flow path 11A which is a main flow path of the high pressure turbine 51 and an intermediate pressure turbine main flow path 11B which is a main flow path of the intermediate pressure turbine 52 are formed between an inner casing 3F and the rotor 2.

The inner casing 3 of the present embodiment has a high pressure inner introduction port 54 through which the steam S1 is introduced into the high pressure turbine main flow path 11A, a high pressure inner discharge port 55 through which steam SIB from the high pressure turbine 51 is discharged, an intermediate pressure inner introduction port 16F through which the steam S1B discharged from the high pressure turbine 51 is introduced into the intermediate pressure turbine main flow path 11B, and an intermediate inner discharge port 17F through which the exhaust steam S2 from the intermediate pressure turbine main flow path 11B is discharged.

The outer casing 5 has a high pressure outer introduction port 53 which is formed radially outside the high pressure inner introduction port 54, a high pressure outer discharge port 56 through which the steam SIB discharged from the high pressure turbine 51 is discharged, an outer intermediate pressure introduction port 22F which is formed radially outside the high pressure inner introduction port 54 and through which the steam S1B discharged from the high pressure outer discharge port 56 is introduced into the intermediate pressure turbine main flow path 11B, and the upper discharge port 23 and the lower discharge port 24 through which the exhaust steam S2 discharged from the intermediate pressure turbine 52 is discharged.

The high pressure turbine 51 has the high pressure inner introduction port 54 which is formed in the inner casing body 15, the high pressure outer introduction port 53 which is formed in the outer casing body 20, and the high pressure outer discharge port 56 which is formed in the outer casing body 20. The high pressure outer discharge port 56 is formed on the one side Da1 in the axial direction from the inner casing 3.

The intermediate pressure turbine 52 has the intermediate inner introduction port 16F and the intermediate inner discharge port 17F which are formed in the inner casing body 15 and the outer intermediate pressure introduction port 22F which is formed in the outer casing body 20. The high pressure outer discharge port 56 of the high pressure turbine 51 and the outer intermediate pressure introduction port 22F of the intermediate pressure turbine 52 are connected to each other by a pipe 70.

The control unit 9 controls the upper valve 7 and the lower valve 8 by a method similar to those of the steam turbines of the first to fifth embodiments. For example, in a case where the steam turbine 1F is the upper half flange support structure and the upper casing 31F moves upward while the steam turbine 1 starts, as shown in FIG. 17, the lower valve 8 is opened, and the exhaust steam S2 having a high temperature flows into the lower casing 32F side.

According to the embodiment, casings of a plurality of turbines are integrated with each other, and thus, the number of the casings decreases, the steam turbine is simplified, and a cost can decrease.

[Circumferential Deviation of Flow Rate of Exhaust Steam S2 Flowing Through Second Main Flow Path 12]

By appropriately using the steam turbines of the embodiments, it is possible to adjust a magnitude of a circumferential deviation of the flow rate of the exhaust steam flowing through the second main flow path 12 of each of the upper portion and the lower portion of the steam turbine 1.

Hereinafter, the circumferential deviation of the flow rate of the exhaust steam will be described in descending order.

(1) Although not shown in the drawings, in a configuration in which one upper discharge port 23 and one lower discharge port 24 are provided, the circumferential deviation of the flow rate of the exhaust steam is largest.

(2) Compared to the configuration in which one upper discharge port 23 and one lower discharge port 24 are provided, in the configuration shown in FIG. 3 in which two upper discharge port 23 and two lower discharge port 24 are provided, the circumferential deviation of the flow rate of the exhaust steam is small.

(3) Compared to the configuration in which two upper discharge port 23 and two lower discharge port 24 are provided, in the configuration shown in FIG. 7 in which three upper discharge port 23 and three lower discharge port 24 are provided, the circumferential deviation of the flow rate of the exhaust steam is small.

(4) In the configuration shown in FIGS. 12 to 14 in which the baffle plate 42 is provided, the circumferential deviation of the flow rate of the exhaust steam can be smallest.

Hereinbefore, the embodiments of the present invention are described in detail. However, various modifications can be added to the present invention within a scope which does not depart from a technical idea of the present invention.

For example, a technology of the present invention can be applied to a steam turbine 1 with which a low pressure turbine is integrated in addition to the high pressure turbine 51 and the intermediate pressure turbine 52.

INDUSTRIAL APPLICABILITY

According to the steam turbine and the steam turbine control method, it is possible to control exhaust steam such that more exhaust steam flows to one of an upper portion and a lower portion of an outer casing by independently controlling an upper valve and a lower valve. By causing more exhaust steam having a high temperature or a low temperature to flow to the upper portion or the lower portion of the outer casing depending on an operation condition the steam turbine, it is possible to promote deformation of the outer casing and set a clearance between a rotor and an inner casing to an appropriate value.

REFERENCE SIGNS LIST

1: steam turbine
2: rotor
3: inner casing
4: stator vane
5: outer casing
6: rotor blade
7: upper valve
8: lower valve
9: control unit
10: rotor body
11: first main flow path
11A: high pressure turbine main flow path
11B: intermediate pressure turbine main flow path
12: second main flow path
13: bearing portion
15: inner casing body
16: inner introduction port
16F: intermediate pressure inner introduction port
17: inner discharge port
17F: intermediate inner discharge port
18: inner insertion hole
20: outer casing body
21: flange portion
22: outer introduction port
22F: outer intermediate pressure introduction port
23: upper discharge port
24: lower discharge port

25: first lid portion
26: second lid portion
28: inner seal portion
29: outer seal portion
31: upper casing
31A: upper casing body
31B: first opening portion
32: lower casing
32A: lower casing body
32B: second opening portion
33: upper half flange
34: lower half flange
35: frame
39: casing temperature sensor
40: flange portion temperature sensor
41: exhaust steam temperature sensor
42: baffle plate
43: closing plate
51: high pressure turbine
52: intermediate pressure turbine
53: high pressure outer introduction port
54: high pressure inner introduction port
55: high pressure inner discharge port
56: high pressure outer discharge port
Da: axial direction
Da1: one side in axial direction
Da2: the other side in axial direction
Dv: upward-downward direction
O1: axis
S1: steam
S2: exhaust steam

The invention claimed is:

1. A steam turbine comprising:

an inner casing which has an inner casing body which covers a rotor that is configured to rotate around an axis extending in a horizontal direction from an outside in a radial direction about the axis and in which a first main flow path through which steam is to flow is defined between an outer peripheral surface of the rotor and the inner casing body and an inner introduction port through which the steam is to be supplied to the first main flow path;

an outer casing which has an outer casing body which covers the inner casing from the outside in the radial direction and defines a second main flow path which is in communication with the first main flow path and through which exhaust steam is to flow between an outer peripheral surface of the inner casing body and the outer casing body, an outer introduction port through which the steam is to be introduced into the inner introduction port, an upper discharge port which is in an upper portion of the outer casing body and through which the exhaust steam is to be discharged from the second main flow path, and a lower discharge port which is in a lower portion of the outer casing body and through which the exhaust steam is to be discharged from the second main flow path;

an upper valve configured to adjust a flow rate of the exhaust steam discharged from the upper discharge port;

a lower valve configured to adjust a flow rate of the exhaust steam discharged from the lower discharge port;

a flange portion which extends to a first side in the horizontal direction and a second side in the horizontal direction from the outer casing body and is supported by a frame from below;

a casing temperature sensor configured to measure a temperature Tc of the outer casing body;

a flange portion temperature sensor configured to measure a temperature Tf of the flange portion; and a control unit configured to control the upper valve and the lower valve based on a difference between the temperature Tc of the outer casing body and the temperature Tf of the flange portion.

2. The steam turbine according to claim 1, wherein:

the outer casing body has an upper casing body which is on an upper side and has a first opening portion which is open downward and a lower casing body which is on a lower side and has a second opening portion which is open upward;

the flange portion has an upper half flange which is on an upper side, extends in the horizontal direction from the first opening portion, and is supported by the frame from below and a lower half flange which is on a lower side, extends in the horizontal direction from the second opening portion, and is fastened to the upper half flange;

a first threshold of a temperature is denoted by Tsh1, and a second threshold of a temperature higher than the first threshold Tsh1 is denoted by Tsh2;

in a case of $Tc-Tf<Tsh1$, the control unit is configured to control the upper valve and the lower valve such that more exhaust steam flows to a lower casing body side of the upper casing body and the lower casing body;

in a case of $Tsh1 \leq Tc-Tf \leq Tsh2$, the control unit is configured to open the upper valve and the lower valve; and in a case of $Tsh2<Tc-Tf$, the control unit is configured to control the upper valve and the lower valve such that more exhaust steam flows to the lower casing body side of the upper casing body and the lower casing body.

3. The steam turbine according to claim 1, further comprising:

an exhaust temperature sensor configured to measure a temperature Tse of the exhaust steam, wherein:

the outer casing body has an upper casing body which is on an upper side and has a first opening portion which is open downward and a lower casing body which is on a lower side and has a second opening portion which is open upward;

the flange portion has an upper half flange which is on an upper side, extends in the horizontal direction from the first opening portion, and is supported by the frame from below and a lower half flange which is on a lower side, extends in the horizontal direction from the second opening portion, and is fastened to the upper half flange;

a first threshold of a temperature is denoted by Tsh1, a second threshold of a temperature higher than the first threshold Tsh1 is denoted by Tsh2, and a third threshold of a temperature is denoted by Tsh3;

in a case of $Tc-Tf<Tsh1$ and $Tc-Tse<Tsh3$, the control unit is configured to control the upper valve and the lower valve such that more exhaust steam flows to an upper casing body side of the upper casing body and the lower casing body;

in a case of $Tc-Tf<Tsh1$ and $Tc-Tse \geq Tsh3$, the control unit is configured to control the upper valve and the lower valve such that more exhaust steam flows to a lower casing body side of the upper casing body and the lower casing body;

in a case of Tsh1≤Tc−T≤Tsh2, the control unit is configured to open the upper valve and the lower valve;

in a case of Tsh2<Tc−Tf and Tc−Tse<Tsh3, the control unit is configured to control the upper valve and the lower valve such that more exhaust steam flows to the lower casing body side of the upper casing body and the lower casing body; and in a case of Tsh2<Tc−Tf and Tc−Tse≥Tsh3, the control unit is configured to control the upper valve and the lower valve such that more exhaust steam flows to the upper casing body side of the upper casing body and the lower casing body.

4. The steam turbine according to claim 1, wherein:

the outer casing body has an upper casing body which is on an upper side and has a first opening portion which is open downward and a lower casing body which is on a lower side and has a second opening portion which is open upward;

the flange portion has a lower half flange which is on a lower side, extends in the horizontal direction from the second opening portion, and is supported by the frame from below and an upper half flange which is on an upper side, extends in the horizontal direction from the first opening portion, and is fastened to the lower half flange;

a first threshold of a temperature is denoted by Tsh1, and a second threshold of a temperature higher than the first threshold Tsh1 is denoted by Tsh2;

in a case of Tc−Tf<Tsh1, the control unit is configured to control the upper valve and the lower valve such that more exhaust steam flows to an upper casing body side of the upper casing body and the lower casing body;

in a case of Tsh1≤Tc−Tf≤Tsh2, the control unit is configured to open the upper valve and the lower valve; and in a case of Tsh2<Tc−Tf, the control unit is configured to control the upper valve and the lower valve such that more exhaust steam flows to the upper casing body side of the upper casing body and the lower casing body.

5. The steam turbine according to claim 1, further comprising:

an exhaust temperature sensor configured to measure a temperature Tse of the exhaust steam, wherein:

the outer casing body has an upper casing body which is on an upper side and has a first opening portion which is open downward and a lower casing body which is on a lower side and has a second opening portion which is open upward;

the flange portion has a lower half flange which is on a lower side, extends in the horizontal direction from the second opening portion, and is supported by the frame from below and an upper half flange which is on an upper side, extends in the horizontal direction from the first opening portion, and is fastened to the lower half flange;

a first threshold of a temperature is denoted by Tsh1, a second threshold of a temperature higher than the first threshold Tsh1 is denoted by Tsh2, and a third threshold of a temperature is denoted by Tsh3;

in a case of Tc−Tf<Tsh1 and Tc<Tse<Tsh3, the control unit is configured to control the upper valve and the lower valve such that more exhaust steam flows to a lower casing body side of the upper casing body and the lower casing body;

in a case of Tc−Tf<Tsh1 and Tc−Tse≥Tsh3, the control unit is configured to control the upper valve and the lower valve such that more exhaust steam flows to an upper casing body side of the upper casing body and the lower casing body;

in a case of Tsh1≤Tc−Tf≤Tsh2, the control unit is configured to open the upper valve and the lower valve;

in a case of Tsh2<Tc−Tf and Tc−Tse≤Tsh3, the control unit is configured to control the upper valve and the lower valve such that more exhaust steam flows to the upper casing body side of the upper casing body and the lower casing body; and in a case of Tsh2<Tc−Tf and Tc−Tse≥Tsh3, the control unit is configured to control the upper valve and the lower valve such that more exhaust steam flows to the lower casing body side of the upper casing body and the lower casing body.

6. The steam turbine according to claim 1, further comprising:

a closing plate which is a plate-shaped member over the outer peripheral surface of the inner casing body and the outer casing body and divides the second main flow path vertically.

7. The steam turbine according to claim 1, further comprising:

a baffle plate configured to uniformly restrict a flow path area of the exhaust steam from the first main flow path to the second main flow path in a circumferential direction, the baffle plate having a plate shape with a main plane orthogonal to the axis.

8. A control method of a steam turbine, the steam turbine including an inner casing which has an inner casing body which covers a rotor that is configured to rotate around an axis extending in a horizontal direction from an outside in a radial direction about the axis and in which a first main flow path through which steam is to flow is defined between an outer peripheral surface of the rotor and the inner casing body and an inner introduction port through which the steam is to be supplied to the first main flow path, an outer casing which has an outer casing body which covers the inner casing from the outside in the radial direction and defines a second main flow path which is in communication with the first main flow path and through which exhaust steam is to flow between an outer peripheral surface of the inner casing body and the outer casing body, an outer introduction port through which the steam is to be introduced into the inner introduction port, an upper discharge port which is in an upper portion of the outer casing body and through which the exhaust steam is to be discharged from the second main flow path, a lower discharge port which is in a lower portion of the outer casing body and through which the exhaust steam is to be discharged from the second main flow path, and a flange portion which extends to a first side in the horizontal direction and a second side in the horizontal direction from the outer casing body and is supported by a frame from below, an upper valve configured to adjust a flow rate of the exhaust steam discharged from the upper discharge port, a lower valve configured to adjust a flow rate of the exhaust steam discharged from the lower discharge port, a casing temperature sensor configured to measure a temperature Tc of the outer casing body, and a flange portion temperature sensor configured to measure a temperature Tf of the flange portion, the control method comprising:

controlling the upper valve and the lower valve based on a difference between the temperature Tc of the outer casing body and the temperature Tf of the flange portion.

9. The control method according to claim 8, wherein:

the outer casing body has an upper casing body which is on an upper side and has a first opening portion which is open downward and a lower casing body which is on a lower side and has a second opening portion which is open upward;

the flange portion has an upper half flange which is on an upper side, extends in the horizontal direction from the first opening portion, and is supported by the frame from below and a lower half flange which is on a lower side, extends in the horizontal direction from the second opening portion, and is fastened to the upper half flange; and a first threshold of a temperature is denoted by Tsh1, and a second threshold of a temperature higher than the first threshold Tsh1 is denoted by Tsh2, wherein the control method further comprises:

controlling, in a case of Tc−Tf<Tsh1, the upper valve and the lower valve such that more exhaust steam flows to a lower casing body side of the upper casing body and the lower casing body;

opening, in a case of Tsh1≤Tc−T≤Tsh2, the upper valve and the lower valve; and controlling, in a case of Tsh2<Tc−Tf, the upper valve and the lower valve such that more exhaust steam flows to the lower casing body side of the upper casing body and the lower casing body.

10. The control method according to claim 8, wherein:

the outer casing body has an upper casing body which is on an upper side and has a first opening portion which is open downward and a lower casing body which is on a lower side and has a second opening portion which is open upward;

the flange portion has an upper half flange which is on an upper side, extends in the horizontal direction from the first opening portion, and is supported by the frame from below and a lower half flange which is on a lower side, extends in the horizontal direction from the second opening portion, and is fastened to the upper half flange; and a first threshold of a temperature is denoted by Tsh1, a second threshold of a temperature higher than the first threshold Tsh1 is denoted by Tsh2, a temperature of the exhaust steam is denoted by Tse, and a third threshold of a temperature is denoted by Tsh3, wherein the control method further comprises:

controlling, in a case of Tc−Tf<Tsh1 and Tc−Tse<Tsh3, the upper valve and the lower valve such that more exhaust steam flows to an upper casing body side of the upper casing body and the lower casing body;

controlling, in a case of Tc−Tf<Tsh1 and Tc−Tse≥Tsh3, the upper valve and the lower valve such that more exhaust steam flows to a lower casing body side of the upper casing body and the lower casing body;

opening, in a case of Tsh1≤Tc−Tf≤Tsh2, the upper valve and the lower valve;

controlling, in a case of Tsh2<Tc−Tf and Tc−Tse<Tsh3, the upper valve and the lower valve such that more exhaust steam flows to the lower casing body side of the upper casing body and the lower casing body; and controlling, in a case of Tsh2<Tc−Tf and Tc−Tse≥Tsh3, the upper valve and the lower valve such that more exhaust steam flows to the upper casing body side of the upper casing body and the lower casing body.

11. The control method according to claim 8, wherein:

the outer casing body has an upper casing body which is on an upper side and has a first opening portion which is open downward and a lower casing body which is on a lower side and has a second opening portion which is open upward;

the flange portion has a lower half flange which is on a lower side, extends in the horizontal direction from the second opening portion, and is supported by the frame from below and an upper half flange which is on an upper side, extends in the horizontal direction from the first opening portion, and is fastened to the lower half flange; and a first threshold of a temperature is denoted by Tsh1, and a second threshold of a temperature higher than the first threshold Tsh1 is denoted by Tsh2, wherein the control method further comprises:

controlling, in a case of Tc−Tf<Tsh1, the upper valve and the lower valve such that more exhaust steam flows to an upper casing body side of the upper casing body and the lower casing body;

opening, in a case of Tsh1≤Tc−Tf≥Tsh2, the upper valve and the lower valve; and controlling, in a case of Tsh2<Tc−Tf, the upper valve and the lower valve such that more exhaust steam flows to the upper casing body side of the upper casing body and the lower casing body.

12. The control method according to claim 8, wherein:

the outer casing body has an upper casing body which is on an upper side and has a first opening portion which is open downward and a lower casing body which is on a lower side and has a second opening portion which is open upward;

the flange portion has a lower half flange which is on a lower side, extends in the horizontal direction from the second opening portion, and is supported by the frame from below and an upper half flange which is on an upper side, extends in the horizontal direction from the first opening portion, and is fastened to the lower half flange; and a first threshold of a temperature is denoted by Tsh1, a second threshold of a temperature higher than the first threshold Tsh1 is denoted by Tsh2, a temperature of the exhaust steam is denoted by Tse, and a third threshold of a temperature is denoted by Tsh3, wherein the control method further comprises:

controlling, in a case of Tc−Tf<Tsh1 and Tc−Tse<Tsh3, the upper valve and the lower valve such that more exhaust steam flows to a lower casing body side of the upper casing body and the lower casing body;

controlling, in a case of Tc−Tf<Tsh1 and Tc−Ts<Tsh3, the upper valve and the lower valve such that more exhaust steam flows to an upper casing body side of the upper casing body and the lower casing body;

opening, in a case of Tsh1≤Tc−Tf<Tsh2, the upper valve and the lower valve;

controlling, in a case of Tsh2<Tc−Tf and Tc−Tse<Tsh3, the upper valve and the lower valve such that more exhaust steam flows to the upper casing body side of the upper casing body and the lower casing body; and controlling, in a case of $Tsh2<Tc-Tf$ and $Tc-Tse \geq Tsh3$, the upper valve and the lower valve such that more exhaust steam flows to the lower casing body side of the upper casing body and the lower casing body.

* * * * *